US006570111B2

(12) United States Patent
Nakagawa et al.

(10) Patent No.: US 6,570,111 B2
(45) Date of Patent: May 27, 2003

(54) ELECTRONIC EQUIPMENT AND TRANSMISSION DEVICE OF BUTTON DEVICE USED THEREIN

(75) Inventors: Kiyoshi Nakagawa, Kuala Lumpur (MY); Koichi Yamaguchi, Yokohama (JP)

(73) Assignees: Sony Corporation, Tokyo (JP); Sony Technology Malaysia SDN. BHD., Selangor Darulehsan (MY)

( * ) Notice: Subject to any disclaimer, the term of this patent is extended or adjusted under 35 U.S.C. 154(b) by 0 days.

(21) Appl. No.: 09/730,668

(22) Filed: Dec. 6, 2000

(65) Prior Publication Data

US 2001/0003325 A1 Jun. 14, 2001

(30) Foreign Application Priority Data

Dec. 8, 1999 (MY) ..... PI9905345

(51) Int. Cl.[7] ..... H01H 3/12

(52) U.S. Cl. ..... 200/343; 200/332; 200/337; 200/344

(58) Field of Search ..... 200/343, 337, 200/345, 341, 344, 332, 332.1

(56) References Cited

U.S. PATENT DOCUMENTS

| | | | | | |
|---|---|---|---|---|---|
| 3,582,584 | A | * | 6/1971 | Best | 200/343 X |
| 3,582,594 | A | * | 6/1971 | Twyford | 200/343 X |
| 4,877,925 | A | * | 10/1989 | Kobayashi | 200/343 X |
| 6,002,093 | A | * | 12/1999 | Hrechor, Jr. et al. | 200/345 |
| 6,215,081 | B1 | * | 4/2001 | Jensen et al. | 200/341 |

* cited by examiner

*Primary Examiner*—Renee Luebke
(74) *Attorney, Agent, or Firm*—Frommer Lawrence & Haug LLP; William S. Frommer; Leonard J. Santisi

(57) ABSTRACT

An electronic equipment having a lever mechanism equipped with a button which when pushed operates an electric switch mounted to a printed wiring circuit board. The lever mechanism includes a first member having an end thereof which is bendably connected to the electronic equipment via a first elastic portion. A second member is also provided in this lever mechanism with an end thereof which is bendably connected to the electronic equipment via a second elastic portion. This elastic portion includes an arm for operating the electric switch. The first lever members are connected by third and fourth elastic portions mounted to the ends of the coupling member to transmit a displacement caused by the bend of the first lever member to the second lever member.

7 Claims, 21 Drawing Sheets

PRIOR ART

PRIOR ART

PRIOR ART

ELECTRONIC EQUIPMENT AND TRANSMISSION DEVICE OF BUTTON DEVICE USED THEREIN

BACKGROUND OF THE INVENTION

1. Field of the Invention

The present invention relates to an electronic equipment such as a VCR (video cassette recorder), etc., and in particular, to a link mechanism of a push-button device mounted to an operation panel of the front surface thereof.

2. Description of the Related Art

On the front panel of the electronic equipment, operating push-buttons are positioned, and in order to link the push-buttons to switches located on printed wiring circuit board, a link mechanism is provided. Conventionally, link mechanisms of various types and constructions have been developed and put into use.

Referring now to FIG. 1 and FIG. 2, the first example of link mechanism of the push-button device of conventional electronic equipment will be described. This link mechanism has a plurality of L-letter-shape lever members 180, and each lever member has a vertical pressing member 183 and a horizontal arm 184. Each lever member 180 is connected to a mount 185 via hinges 186.

On the outer surface of the pressing member 183, a protruding button 189 is mounted. The top end of the arm 184 is arranged on a push-button type switch 210 mounted on a printed wiring circuit board 200. As shown in FIG. 2, pressing the button 189 with a finger causes the L-letter-form lever member 180 to pivotally move around a pivot axis perpendicular to the paper surface passing through the hinges 186, and the top end of the arm 184 of the lever member moves downwards. This will activate the push-button type switch 210.

Referring now FIG. 3 and FIG. 4, the second example of link mechanism of the push-button device of conventional electronic equipment will be described. This link mechanism has a plurality of L-letter-shape lever members 190 (FIG. 3 and FIG. 4 shows only one of them), and each lever member has a vertical pressing member 193 and a horizontal arm 194. On the top end of the vertical pressing member 193, a hinge 192 is mounted and above the hinge 192, a mount 191 is fitted. The mount 191 is mounted to a cabinet of the electronic equipment.

On the outer surface of the pressing member 193, a protruding button 199 is mounted. The top end of the arm 194 is arranged on a push-button type switch 220 located on a printed wiring circuit board 200. As shown in FIG. 4, pressing the button 199 causes the L-letter-shape lever member 190 to pivotally move around the pivot axis perpendicular to the paper surface passing through the hinge 192, and the top end of the arm 194 of the lever member moves in the horizontal direction. This actuates the push-button type switch 220.

With the link mechanism of the push-button device of conventional electronic equipment, it was difficult to change the position of push-buttons resulting from design changes. For example, varying the push-button position along the vertical direction on pressing members 183, 193 causes the length of arm of moment of force to be changed, and the magnitude of force exerted on the push-button type switch varies. Varying the push-button position along the horizontal direction causes the line of action of force exerted on the switch to be changed, and the lever member is twisted.

Consequently, the force applied to the push-button switch is varied and the operating feeling is degraded.

In the example of FIG. 3 and FIG. 4, the top end of the arm 194 moves in the horizontal direction. Consequently, in this example, it is necessary to use a longitudinal-type switch that is actuated by applying force in the lateral direction. The longitudinal-type switch has a disadvantage of high price as compared to a flat-type switches as used in the example of FIG. 1 and FIG. 2.

In these examples, the lever member is of a construction cantilevered by a hinge, and when this is fabricated by molding, the lever member is easy to be bent at the thinner portion of the hinge, and there is some possibility to generate defective products.

Consequently, it is an object of the present invention to provide an electronic equipment in which it is comparatively easy to freely choose the push-button position and a link equipment of such push-button device.

It is an object of the present invention to provide an electronic equipment equipped with a push-button device with excellent operability.

SUMMARY OF THE INVENTION

According to the present invention, in an electronic equipment comprising a link mechanism formed with one member equipped with a button for operating the electronic equipment and applied to operate an electric switch disposed in a printed wiring circuit board for a main circuit of the electronic equipment by the force applied to the button, the electronic equipment comprises

- a first lever member whose one end is bendably connected to the electronic equipment via the first elastic portion and which is applied to be bent by the force applied to the button,
- a second lever member whose one end is bendably connected to the electronic equipment via the second elastic portion and which protrudes in the direction opposite to the button and is equipped with an arm for operating the electric switch, and
- a third elastic portion for connecting the first lever member to the second lever member and transmitting the displacement caused by the bend of the first lever member to the second lever member.

According to the present invention, in a link equipment comprising a link mechanism for transmitting the force applied to a button mounted to an electronic equipment to an electric switch mounted at a specified location of the electronic equipment and a frame-form portion equipped with a fitting portion for fixing to the electronic equipment, and the link mechanism and the frame-form portion are formed from one member, the link equipment comprises

- a first lever member whose one end is bendably connected to the electronic equipment via a first elastic portion and which is bent by the force applied by the button,
- a second lever member whose one end is bendably connected to the electronic equipment via the second elastic portion and which protrudes in the direction opposite to the button and is equipped with an arm for operating an electric switch, and
- a third elastic portion for linking the first and the second lever members and for transmitting displacement caused by the bend of the first lever member to the second lever member. By the way, the elastic portion may be called a bent portion or hinge in embodiments of the present invention.

The printed circuit board for the main circuit is positioned so that the end of the board is close to or abuts the rear surface of the front panel. The link mechanism of the present invention connects between the button means on the front panel and the switch means on the printed circuit board. Accordingly, the printed circuit board for the main circuit can include the switch circuit and therefore it is not necessary to provide a printed circuit board for the switch circuit separately.

As described above, because the link mechanism is fixed on both sides and the first lever member and the second lever member rotate around a pivot axis different from each other, satisfactory operating feeling is obtained even when the push-button position is varied from top to bottom. To look at this from a different viewpoint, since the link mechanism has a construction to link two lever members with one linking member, varying the length of two lever members subtly varies the force for pressing the button and the stroke of moving the button, and a button device with satisfactory operation feeling is able to be obtained.

DETAILED DESCRIPTION OF THE PREFERRED EMBODIMENT

Figure 5:
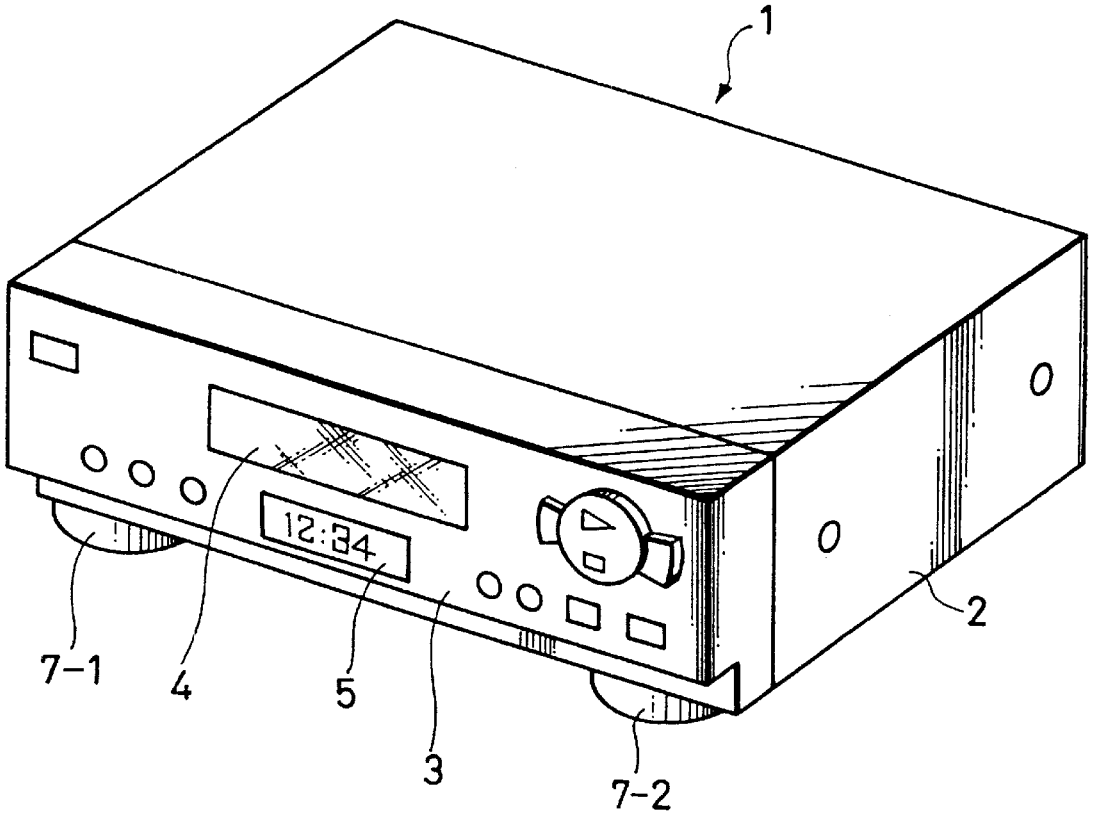
FIG. 5 is a perspective view drawing showing the appearance of an electronic equipment according to the present invention.

Referring now to FIG. 5, description will be made on VCR (video cassette recorder) as an example of the electronic equipment equipped with the link mechanism of the push-button device according to the present invention. VCR 1 has a main body 2 and front panel, that is, operation panel 3, on which a tape cassette slot 4, display panel 5, push-buttons, etc. are equipped. On the bottom at the front end of VCR 1, a pair of legs 7-1, 7-2 are equipped.

Figure 6:
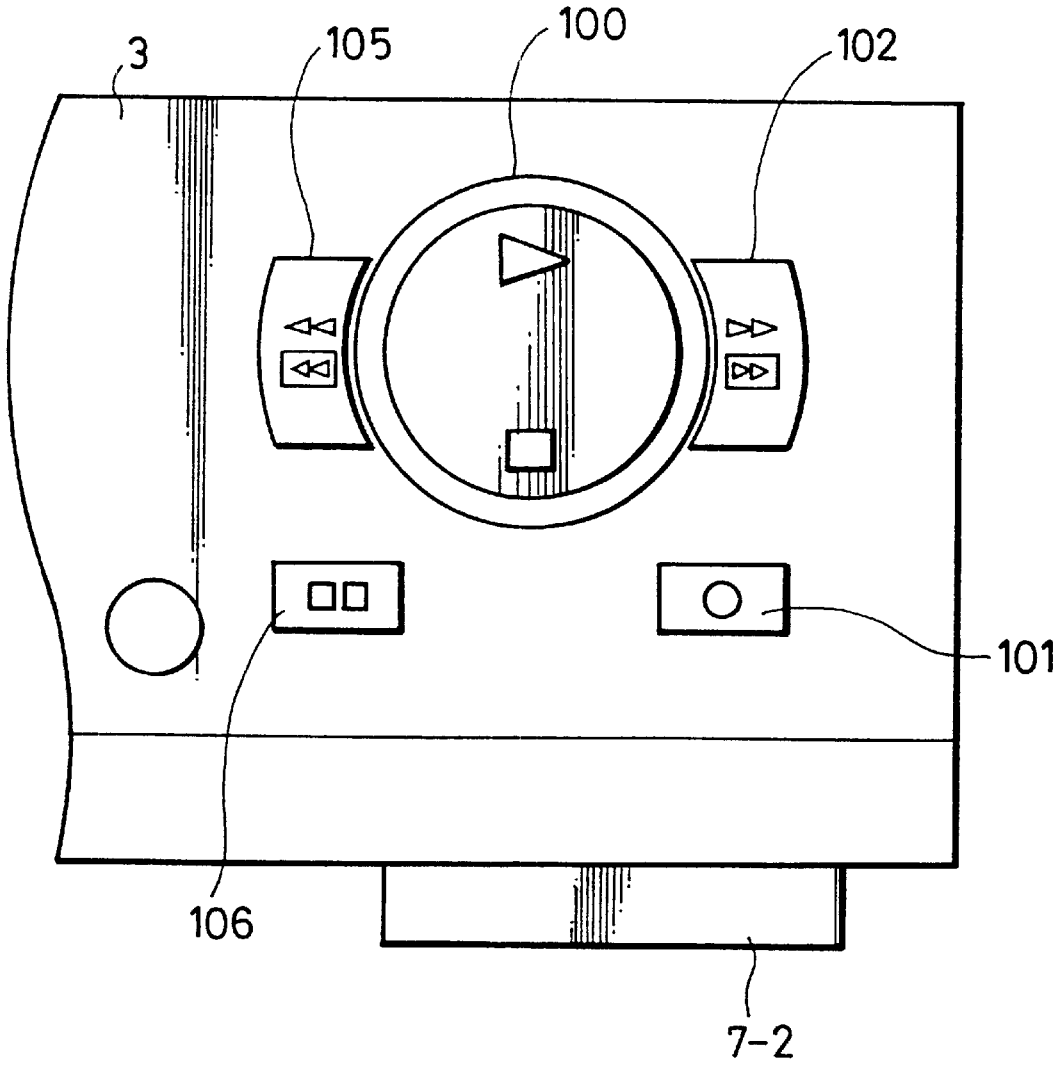
FIG. 6 is a drawing showing push-buttons on the front panel of the electronic equipment in FIG. 5.

Referring now to FIG. 6, push-buttons provided on the front panel 3 are described. Push-buttons include a round play/stop button 100, fast-forward/cue button 102 and rewind/review button 105 located on opposite sides of the button 100, recording button 101 below, pause button 106, etc. On the surface of the play/stop button 100, a triangle is displayed on the upper side and a rectangle on the lower side. Pressing the triangle portion brings the play mode, while pressing the rectangle portion brings the stop mode.

Pressing the fast-forward/cue button 102 in the stop mode brings the fast-feed mode, and quickly feeds the tape without displaying images. Pressing the fast-forward/cue button 102 brings the cue mode, in which the tape is quickly fed while images are being displayed. Pressing the rewind/review button 105 in the stop mode brings the rewind mode, and the tape is rewound without displaying images. Pressing the rewind/review button 105 in the play mode brings the review mode and the tape is rewound while images are being displayed. There are other push-buttons on the front panel 3, but the description thereof will be omitted.

Figure 7:
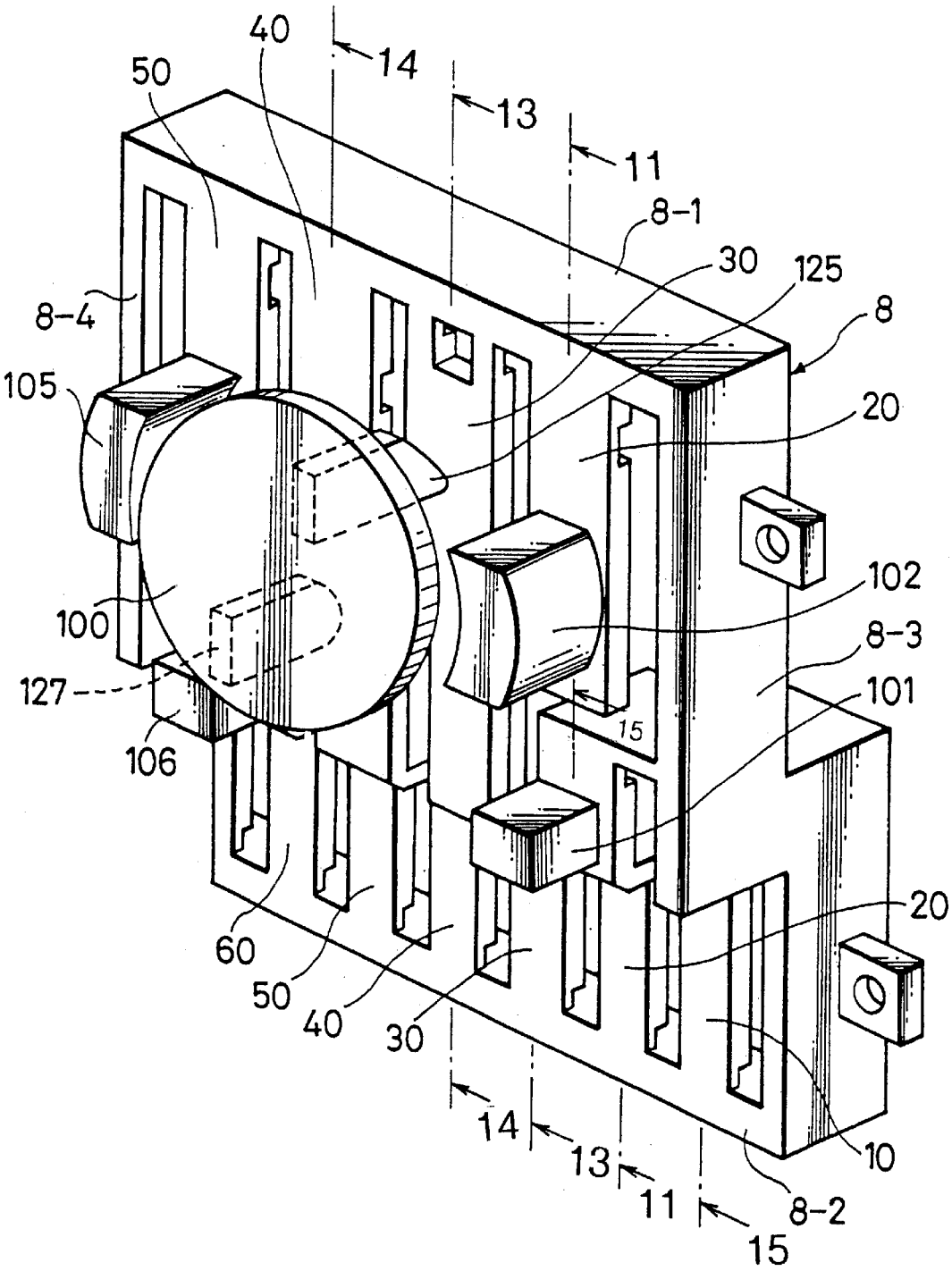
FIG. 7 is a perspective view showing the front construction of the link equipment according to the present invention.
Figure 8:
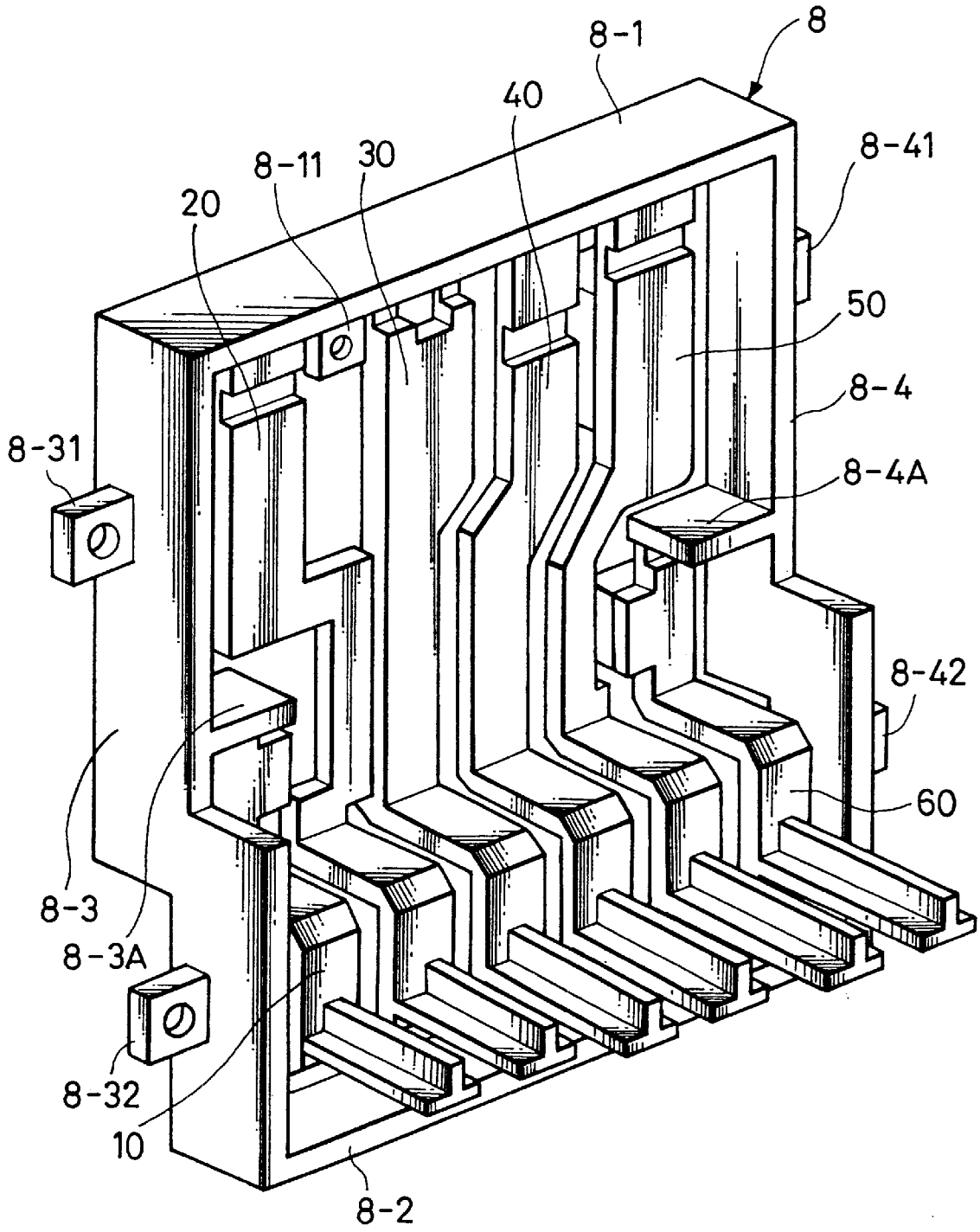
FIG. 8 is a perspective view showing the back construction of the link equipment according to the present invention.
Figure 9:
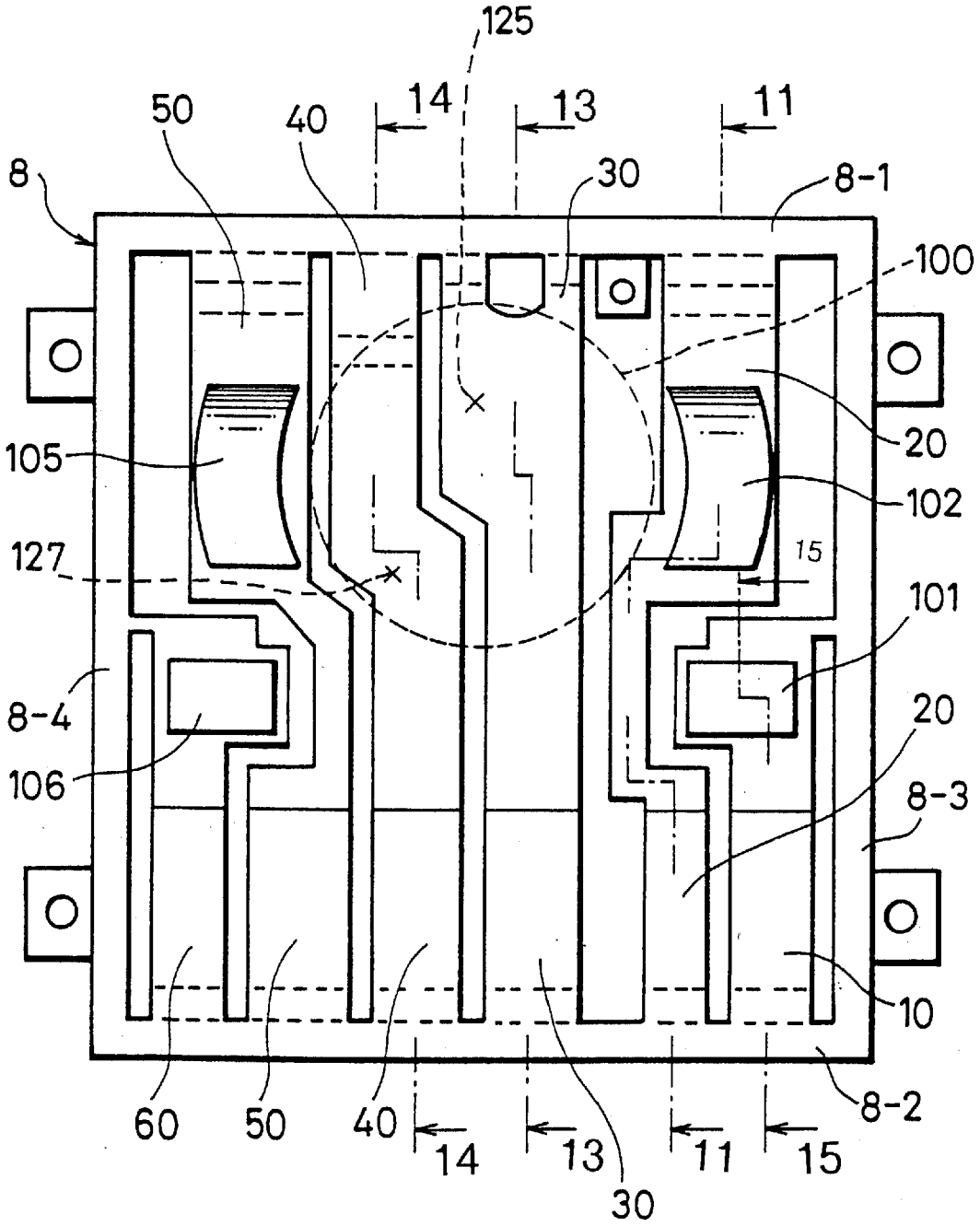
FIG. 9 is a front view showing the relationship between the link equipment and push-button according to the present invention.

Referring now to FIG. 7, FIG. 8, and FIG. 9, an example of a link device of the push-button of electronic equipment according to the present invention will be described. The link device of this example includes a nearly rectangular frame 8 and six link members 10, 20, 30, 40, 50, 60 arranged in this frame. The first link member 10 is mounted in correspondence with the recording button 101, the second link member 20 is mounted in correspondence with the fast-forward/cue button 102, the third and the fourth link members 30,40 are mounted in correspondence with the play/stop button 100, the fifth link member 50 is mounted in correspondence with the rewind/review button 105, and the sixth link member 60 is mounted in correspondence with the pause button 106.

The recording button 101, fast-forward/cue button 102, rewind/review button 105 and pause button 106 may be formed integral with the first, second, fifth and sixth link members 10, 20, 50, 60, respectively. The play/stop button 100 may be configured separately as different members from the third and the fourth link members 30, 40. On the rear surface of the play/stop button 100, two protrusions 125, 127 are provided, and these protrusions are configured in such a manner as to come in contact with the third and the fourth link members 30, 40, respectively.

FIG. 8 shows the construction of the rear surface of the link device. As illustrated, the second, third, fourth, and fifth link members 20, 30, 40, 50 extend from the upper member 8-1 of the frame 8 to the lower frame member 8-2, and the first and the sixth link members 10, 60 extend to the lower frame 8-2 from protrusions 8-3A and 8-4A of lateral frame portions 8-3, 8-4. Between these adjoining link members, clearances are formed.

A mount may be mounted to the frame 8 for fitting the link device to the cabinet 3 of electronic parts. In the present example, the first mount 8-11 is mounted to the lower side of the upper frame member 8-1, and the second mount (not illustrated) is also mounted in the same manner on the upper side of the lower frame member 8-2. To the lateral frame members 8-2, 8-3, the third mounts 8-31, 8-32, 8-41, 8-42 are mounted, respectively. These mounts may be formed integral with the frame 8.

As shown in FIG. 9, the first through the sixth link members 10, 20, 30, 40, 50, 60 may not be straight but bent, or may have the width varied halfway. The frame 8 and link members 10, 20, 30, 40, 50, 60 may be formed by molding and preferably formed with a single member. If the frame 8 and link members 10, 20, 30, 40, 50, 60 are formed with a single member by integral molding in this way, both ends of each link member are connected to the frame. Consequently, even if the link member contains thin-wall hinges, there is little possibility to generate defective products due to deformation, etc in the molding process. In such event, the frame 8 may be a closed rectangle as illustrated, but may be a rectangle with one side opened, and a desired shape is chosen as required.

What is important is that both ends of each link member are connected to the frame at positions different from each other, and the frame and the link member connected to the frame are formed integral. Since both ends of the link member are supported to the frame in this way, each link member is prevented from being deformed during the molding process.

Referring now to FIG. 10 through FIG. 15, the construction of each link member will be described. First of all, referring to FIGS. 10, 11, and 12, the second link member 20 will be described. The second link member 20 has the first hinges 22, first lever member 23, second hinges 24, coupling member 25, third hinge 26, the second lever member 27 of T-letter-shape, and the fourth hinges 28. The first through the fourth hinges 22, 24, 26, 28 may be formed as thin-wall portion of the link member 20 as illustrated.

The first lever member 23 may be arranged vertically, and to the outer surface, a fast-feed/cue button 102 is equipped. As described above, the fast-feed/cue button 102 may be formed integral with the first lever member 23. The fast-feed/cue button 102 is mounted in such a manner as to protrude from the opening portion 3A of the front panel 3. The first hinge 22 and the fourth hinge 28 are mounted to the upper frame member 8-1 and the lower frame member 8-2 of the frame, respectively. The upper member 8-1 and the lower member 8-2 of the frame are mounted to the front panel 3.

The second lever member of T-letter-form 27 has a vertical portion 27A and a horizontal arm 27B, and the top end of the arm 27B is arranged on the switch 212 which is mounted to the printed wiring circuit board 200.

Figure 12:
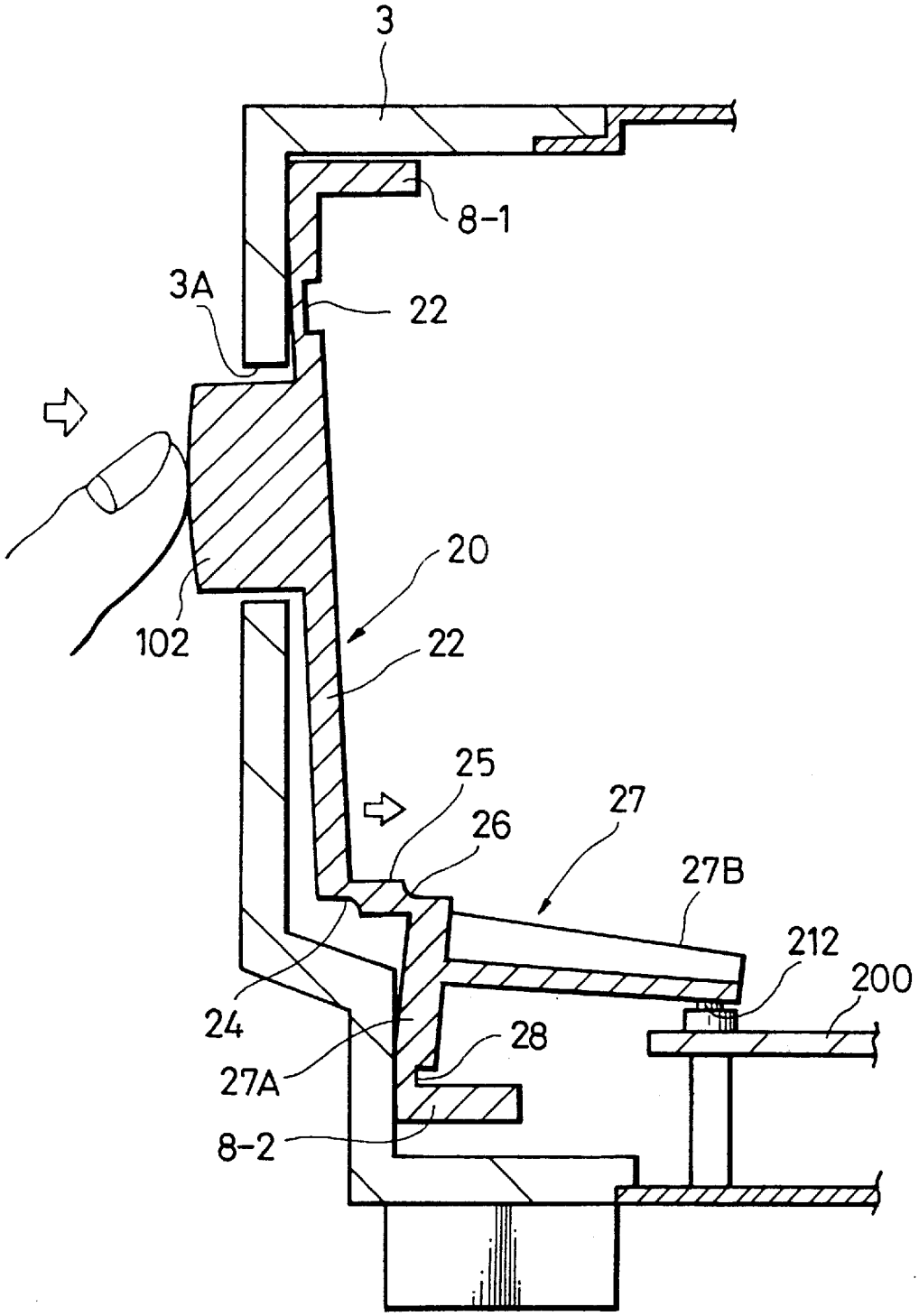
FIG. 12 is a cross sectional view similar to FIG. 11 showing the push-button pressed.

As shown in FIG. 12, pressing the fast-feed/cue button 102 pivotally moves the first lever member 23 around the pivot axis perpendicular to the paper surface passing through the first hinges 22. This causes the lower end of the first lever member 23 to move inwards in the horizontal direction as shown by an arrow mark. The movement of the bottom end of the first lever member 23 is transmitted to the second lever member 27 of T-letter-form via the coupling member 25. This causes the second lever member 27 to pivotally move around the pivot axis perpendicular to the paper surface passing through the fourth hinge 28. The top end of the arm 27B of the second lever member 27 moves downwards and the switch 212 is actuated.

The first lever member 23 pivotally moves counterclockwise, while the second lever member 27 pivotally moves clockwise. Consequently, the motion locus of the bottom end of the first lever member 23 does not become identical to the motion locus of the top end of the second lever member 27. On both ends of the coupling member 25, the second and the third hinges 24, 26 are mounted, and by the deformation of these two hinges 24, 26, the coupling member 25 is able to freely move. By the movement of the coupling member 25, deviation between the two motion loci is able to be absorbed.

Figure 13:
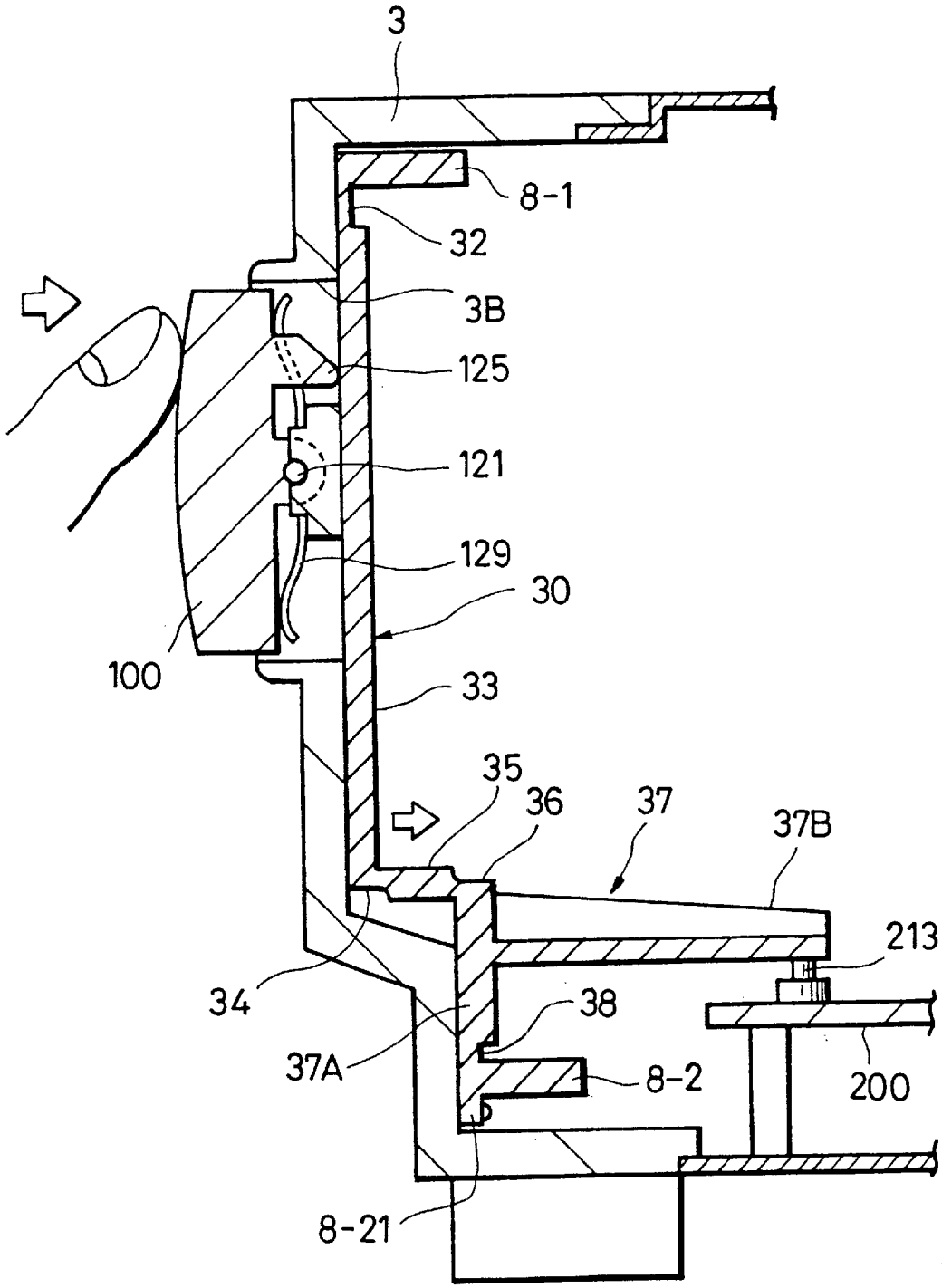
FIG. 13 is a cross-sectional view of the link equipment according to the present invention taken on line 13—13 of FIG. 7 and FIG. 9.
Figure 14:
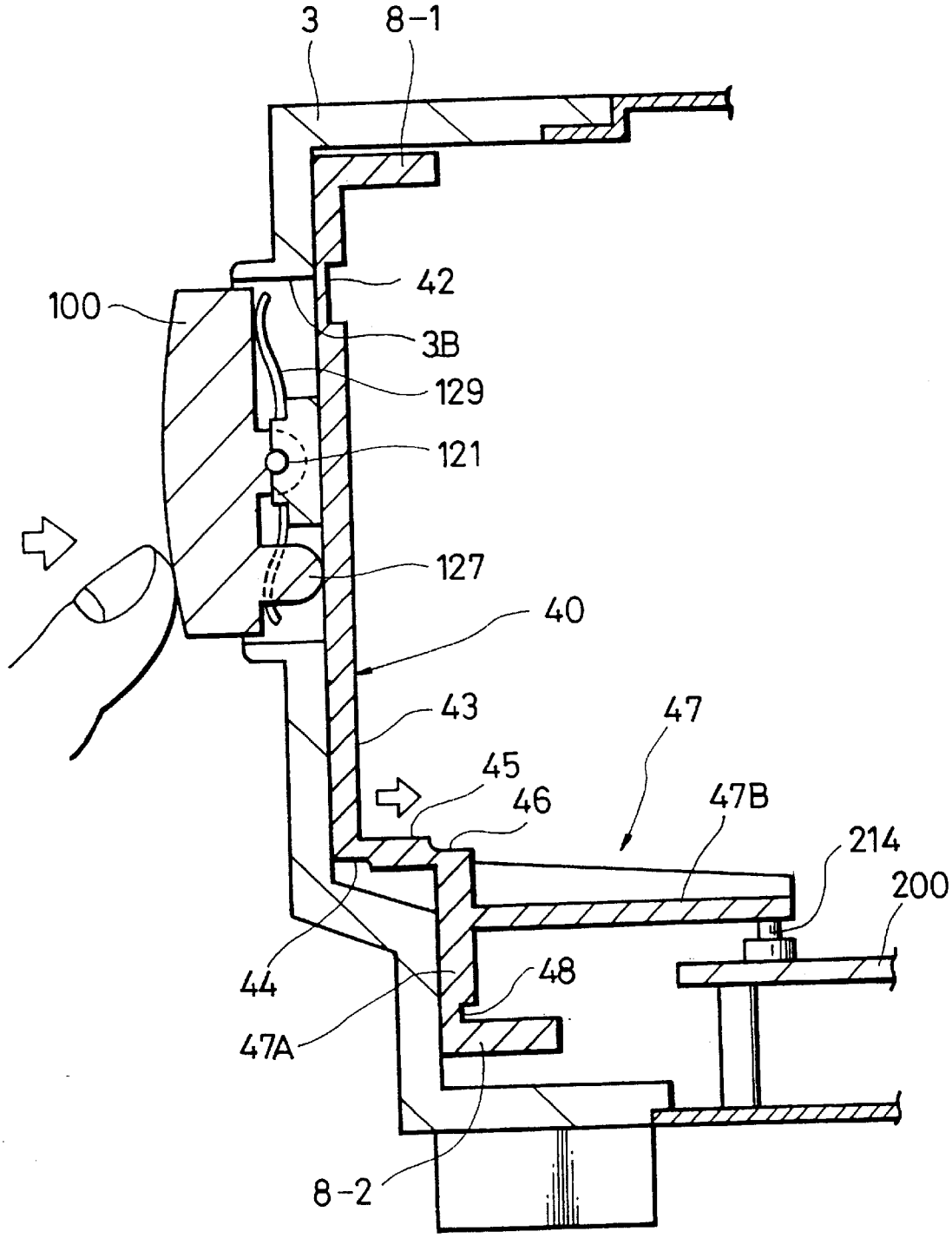
FIG. 14 is a cross-sectional view of the link equipment according to the present invention taken on line 14—14 of FIG. 7 and FIG. 9.

Referring now to FIG. 13 and FIG. 14, the third and the fourth link members 30, 40 are described. The third and the fourth link members 30, 40 have the first hinges 32, 42, first lever members 33, 43, second hinges 34, 44, coupling members 35, 45, third hinges 36, 46, T-letter-form second lever members 37, 47, and the fourth hinges 38, 48 respectively. The first through the fourth hinges 32, 42, 34, 44, 36, 46, 38, 48 may be configured as a thin-wall portion of link members 30, 40 as illustrated.

The first lever members 33, 43 may be arranged vertically, and on the front side, the play/stop button 100 is arranged. The play/stop button 100 is arranged in the opening portion 3B of the front panel 3. The first hinges 32, 42 and the fourth hinges 38, 48 are mounted to the upper frame member 8-1 and the lower frame member 8-2 of the frame, respectively. The mount 8-21 provided on the frame is mounted to the front panel 3 as illustrated.

The second lever members 37, 47 of T-letter-form have vertical portions 37A, 47A and horizontal arms 37B, 47B, and the top ends of the arms 37B, 47B are arranged on the switches 213, 214 which are mounted to the printed wiring circuit board 200.

As shown in FIG. 6, at the top side on the front surface of the play/stop button 100, a triangle indicating "play" is attached, and at the bottom side, a rectangle indicating "stop" is attached. On the other hand, on the rear surface of the play/stop button 100, protrusions 125 (FIG. 13, FIG. 7) and 127 (FIG. 14, FIG. 7) corresponding thereto are provided. The X mark in FIG. 9 indicates the locations of the protrusions 125, 127. As illustrated, the top protrusion 125 mounted correspondingly to the "play" indication (triangle) is arranged above the first lever member 33 of the third link member 30, and the bottom protrusion 127 mounted correspondingly to the "stop" indication (rectangle) is arranged above the first lever member 43 of the fourth link member 40.

As shown in FIG. 13 and FIG. 14, the play/stop button 100 is pivotally mounted around the pivot axis 121. This pivot axis 121 traverses the center of the play/stop button 100 at the back of the play/stop button 100, and is arranged horizontally, that is, perpendicular to the paper surface. By the way, a spring 129 is mounted adjacent to the pivot axis 121, and the play/stop button 100 is energized to return to the original position by this spring 129.

FIG. 13 is now referred. Pressing the "play" indication (triangle) at the top side on the play/stop button 100 rotates the play/stop button 100 around the pivot axis 121 clockwise and the top-side protrusion 125 moves inwards. By this motion, the first lever member 33 of the third link member 30 pivotally moves around the first hinge 32. The bottom end of the first lever member 33 moves inwards in the horizontal direction as shown by an arrow mark. The movement of the bottom end of the first lever member 33 is transmitted to the second lever member 37 of T-letter-form via the coupling member 35. By this motion, the second lever member 37 pivotally moves around the pivot axis perpendicular to the paper surface passing through the fourth hinges 38. The top end of the arm 37B of the second lever member 37 moves downwards and the switch 213 is actuated.

FIG. 14 is referred. Pressing the "stop" indication (rectangle) at the bottom side on the play/stop button 100 rotates the play/stop button 100 around the pivot axis 121 counterclockwise and the bottom-side protrusion 127 moves inwards. By this motion, the first lever member 43 of the fourth link member 40 pivotally moves around the first hinge 42. The bottom end of the first lever member 43 moves inwards in the horizontal direction as shown by an arrow mark. The movement of the bottom end of the first lever member 43 is transmitted to the second lever member 47 of T-letter-form via the coupling member 45. By this motion, the second lever member 47 pivotally moves around the pivot axis line perpendicular to the paper surface passing the fourth hinges 48. The top end of the arm 47B of the second lever member 47 moves downwards and the switch 214 is actuated.

Figure 15:
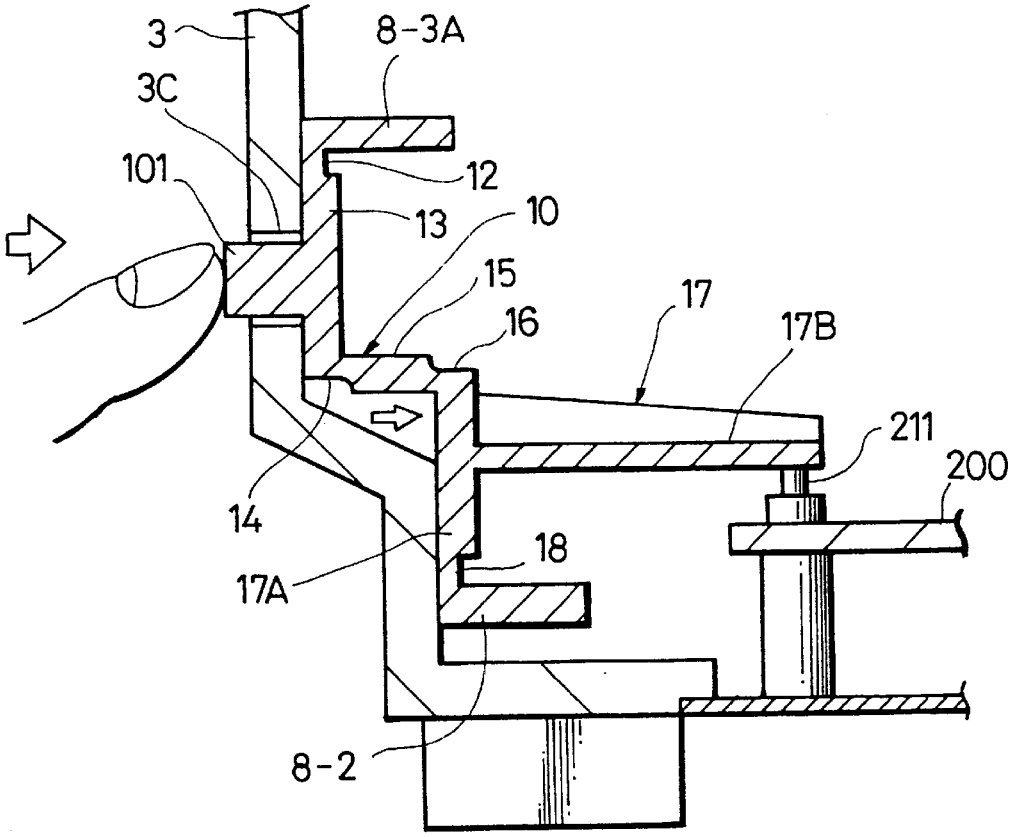
FIG. 15 is a cross-sectional view of the link equipment according to the present invention taken on line 15—15 of FIG. 7 and FIG. 9.

Referring now to FIG. 15, the first link member 10 will be described. The first link member 10 has a first hinge 12, first lever member 13, second hinge 14, link member 15, third hinge 16, second lever member 17 of T-letter-form, and fourth hinge 18. The first through the fourth hinges 12, 14, 16, 18 may be configured as a thin-wall portion of the link member 10 as illustrated.

Figure 1:
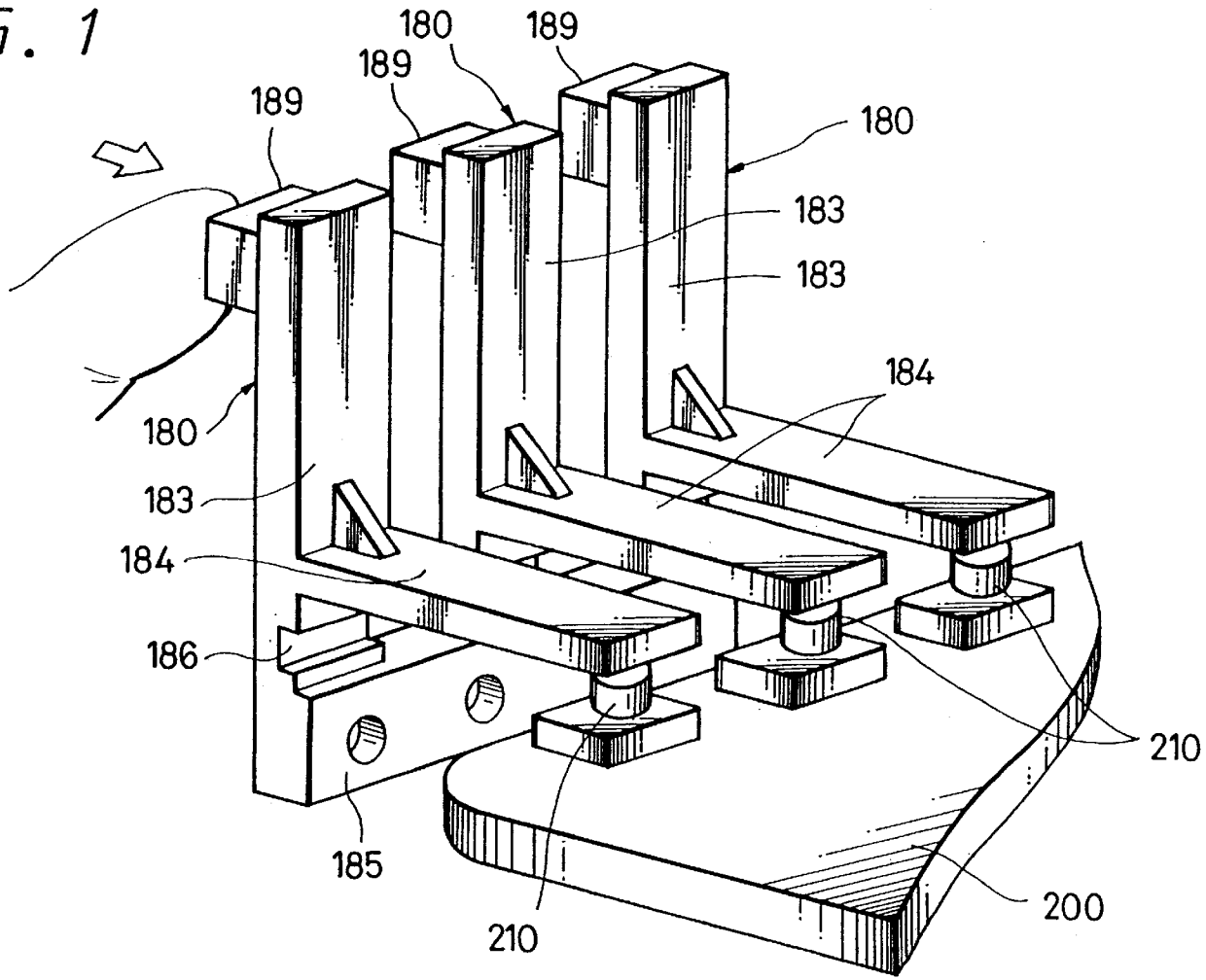
FIG. 1 PRIOR ART
FIG. 1 is a perspective view showing part of the first example of conventional link equipment.
Figure 2:
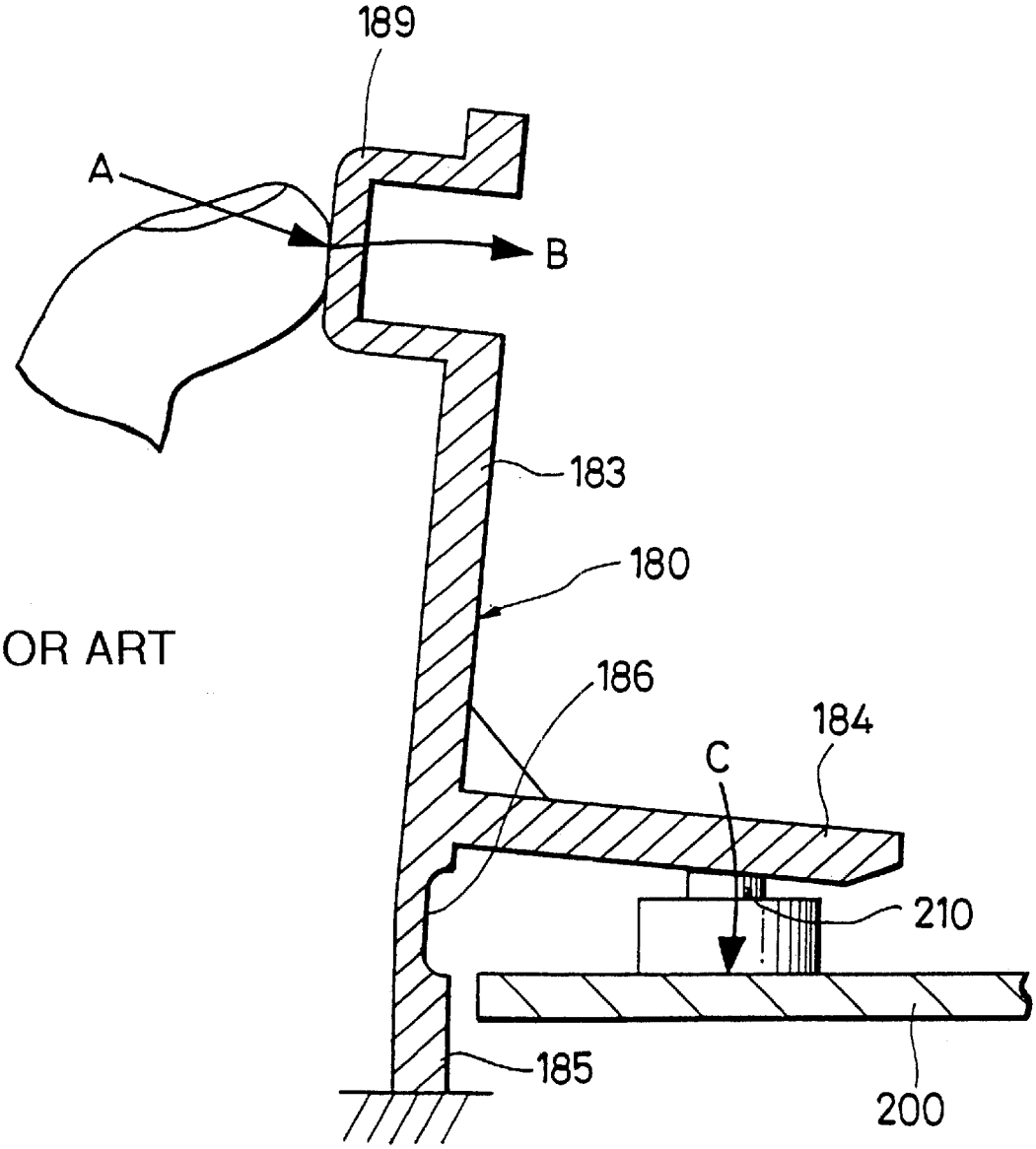
FIG. 2 is a cross-sectional view of the first example of FIG. 1.
Figure 3:
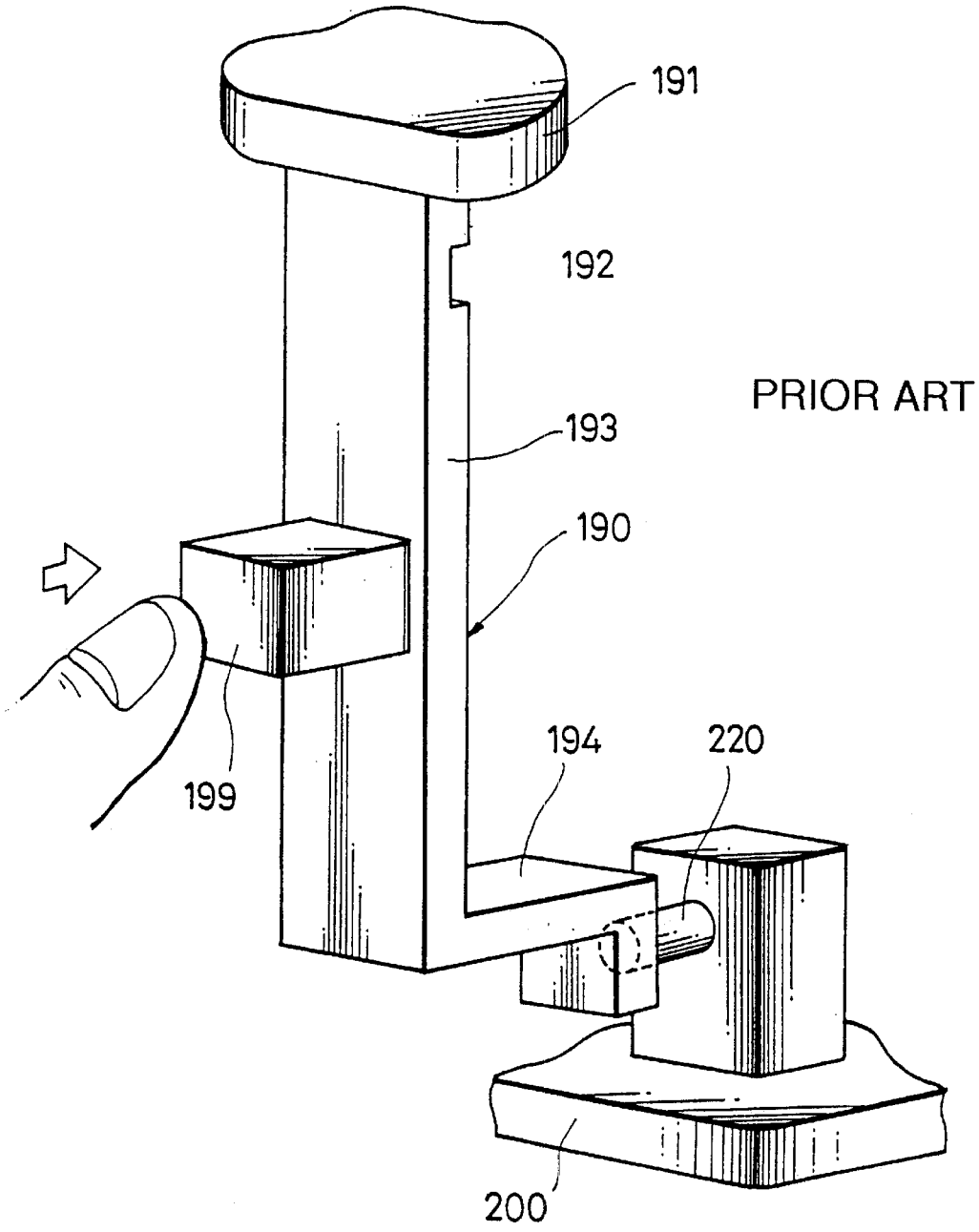
FIG. 3 is a perspective view showing part of the second example of conventional link equipment.
Figure 4:
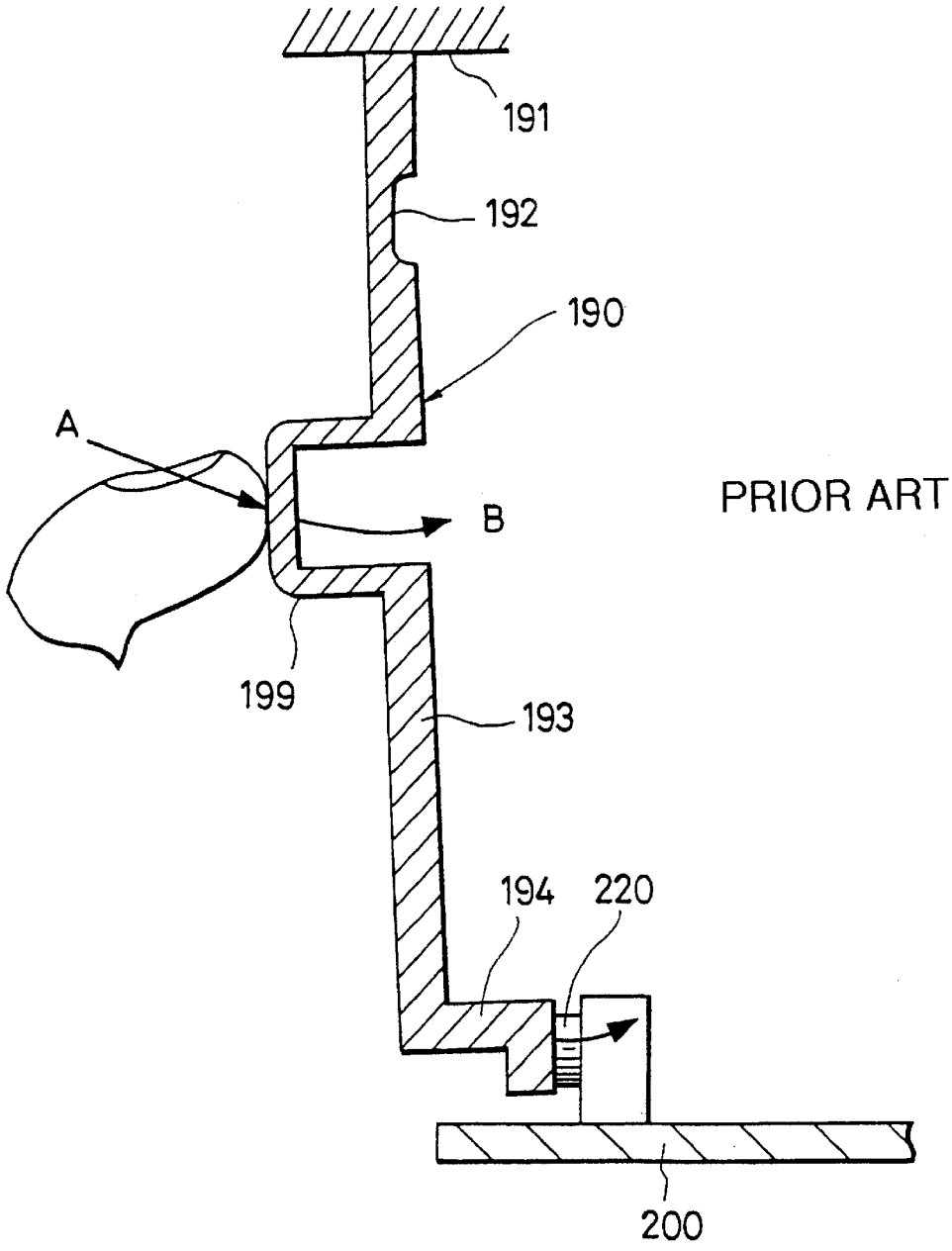
FIG. 4 is a cross-sectional view of the second example of FIG. 3.

The first lever member 13 may be arranged vertically, and to the outer surface, a recording button 101 is mounted. As described above, the recording button 101 may be formed integral with the first lever member 13. The recording button 101 is provided in such a manner as to protrude from the opening portion 3C of the front panel 3. As described referring to FIG. 4, the first hinges 12 is mounted to protrusion 8-3A of the lateral frame member 8-3 of the frame. The fourth hinge 18 is mounted to the lower frame member 8-2 of the relevant frames.

Figure 10:
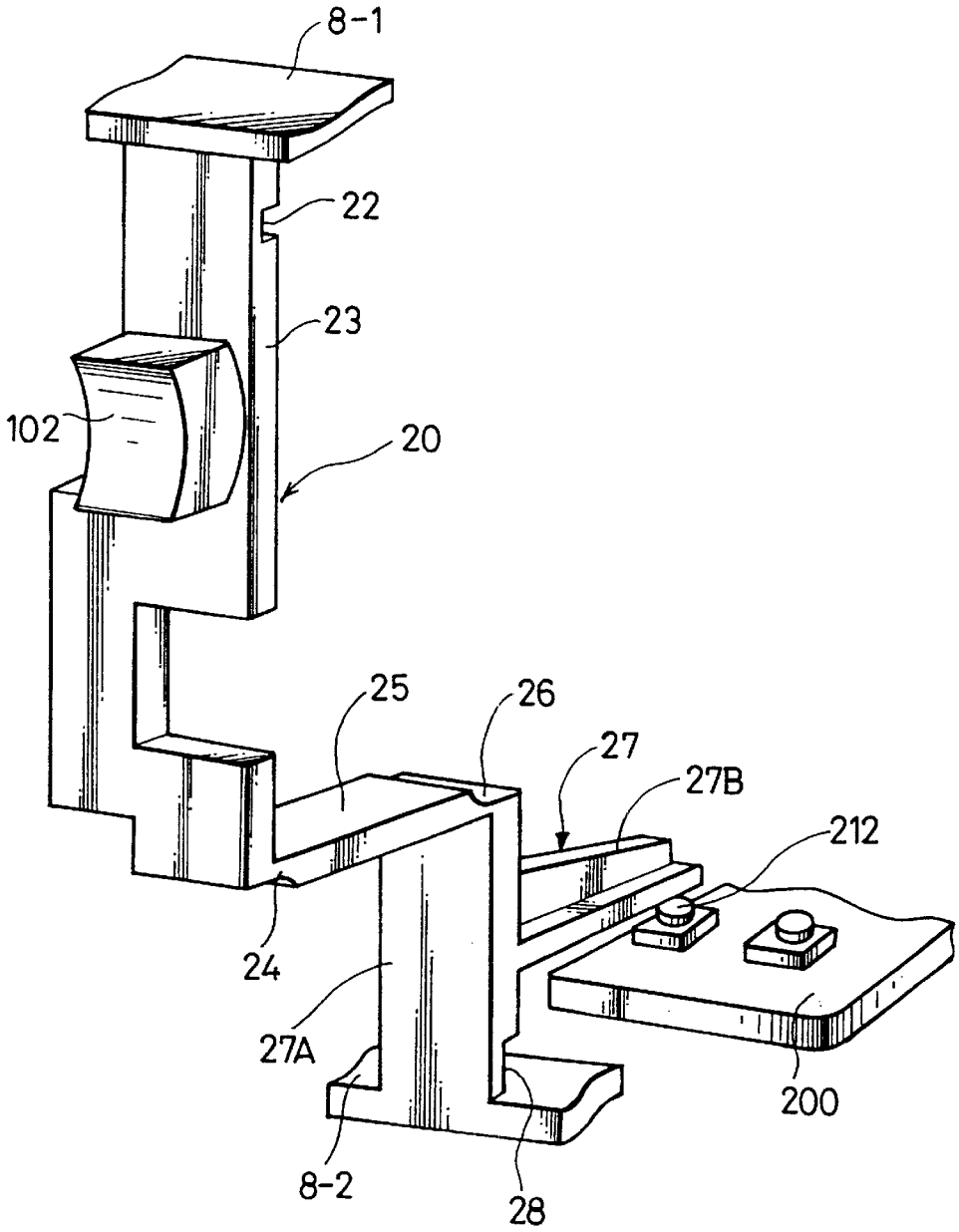
FIG. 10 is a perspective view of the link member of the link equipment according to the present invention.
Figure 11:
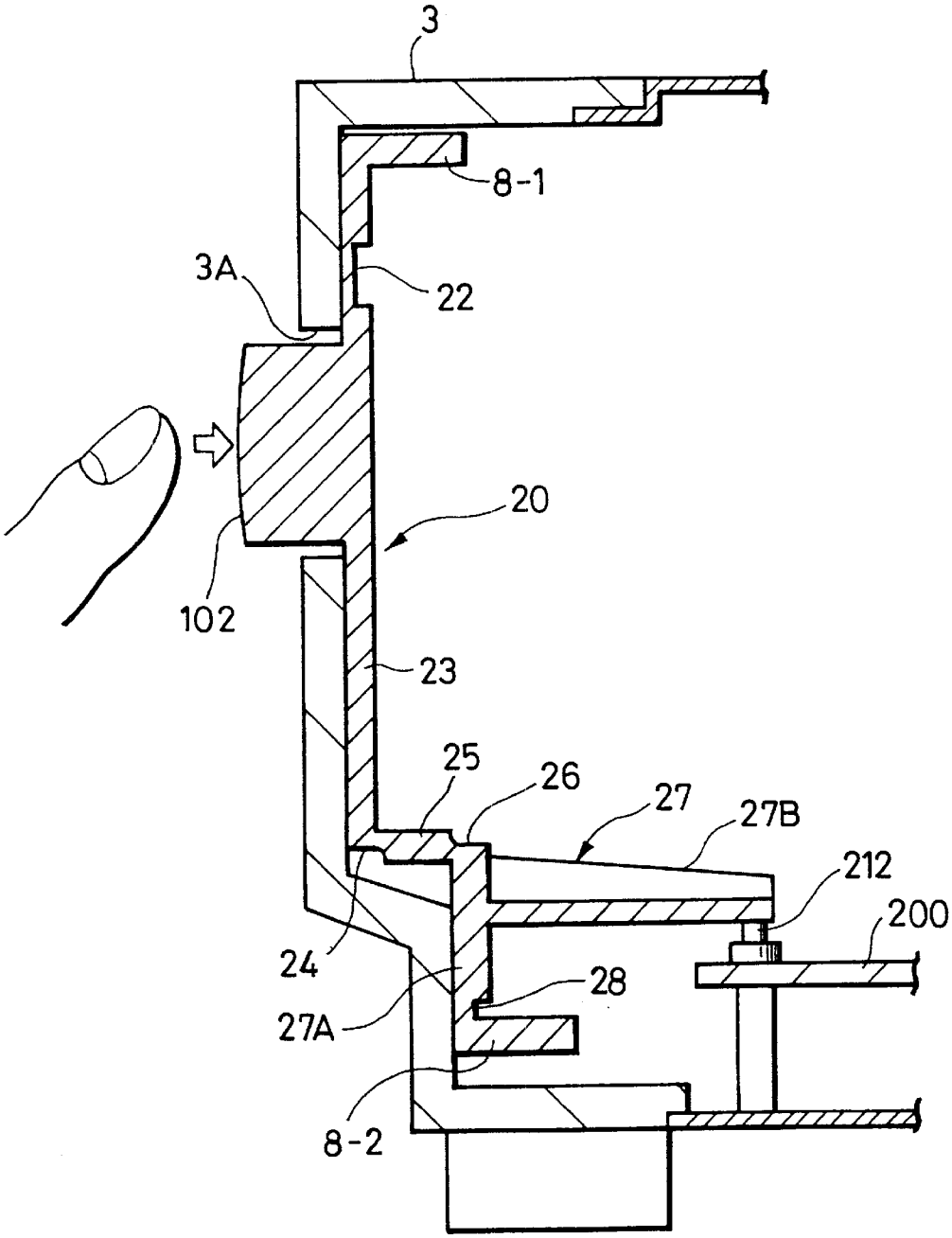
FIG. 11 is a cross sectional view of the link equipment according to the present invention taken along line 11—11 of FIG. 7 and FIG. 9.

The construction of the first link member 10 is shorter in the longitudinal length as compared to the second link member 20 described referring to FIG. 10, FIG. 11, and FIG. 12, and differs in the point that the first hinges 12 are mounted on the protrusion 8-3A of the lateral frame member 8-3 in place of the upper frame member 8-1 of the frame. It also differs in the point that the recording button 101 is mounted on the first lever member 13 in place of the fast-feed/cue button 102. However, the operation is basically the same as the second link member 20.

That is, when the recording button 101 is pressed, the first lever member 13 pivotally moves around the pivot axis perpendicular to the paper surface passing through the first hinge 12. By this motion, the bottom end of the first lever member 13 moves inwards in the horizontal direction as shown by an arrow mark. The movement of the bottom end of the first lever member 13 is transmitted to the second lever member 17 via the coupling member 15. By this motion, the second lever member 17 pivotally moves around the pivot axis perpendicular to the paper surface passing through the fourth hinge 18. The top end of the arm 17B of the second lever member 17 moves downwards and the switch 211 is actuated.

By the way, the fifth link member 50 mounted in correspondence with the rewind/review button 105 may have the construction and functions similar to those of the second link member 20. In addition, the sixth link member 60 mounted in correspondence with the pause button 106 may have the constructions and functions similar to those of the first link member 10. Consequently, the description on construction and functions of the fifth link member 50 and sixth link member 60 will be omitted.

In the first example of the link device of the present invention as described above, link members 10, 20, 30, 40, 50, 60 rotate around the pivot axis passing through the first and the fourth hinges which differ from each other, and the first and the fourth hinges are fixed, respectively. Consequently, the example has features of good operation feeling of push-buttons mounted to the first lever member of the link member.

Figure 16:
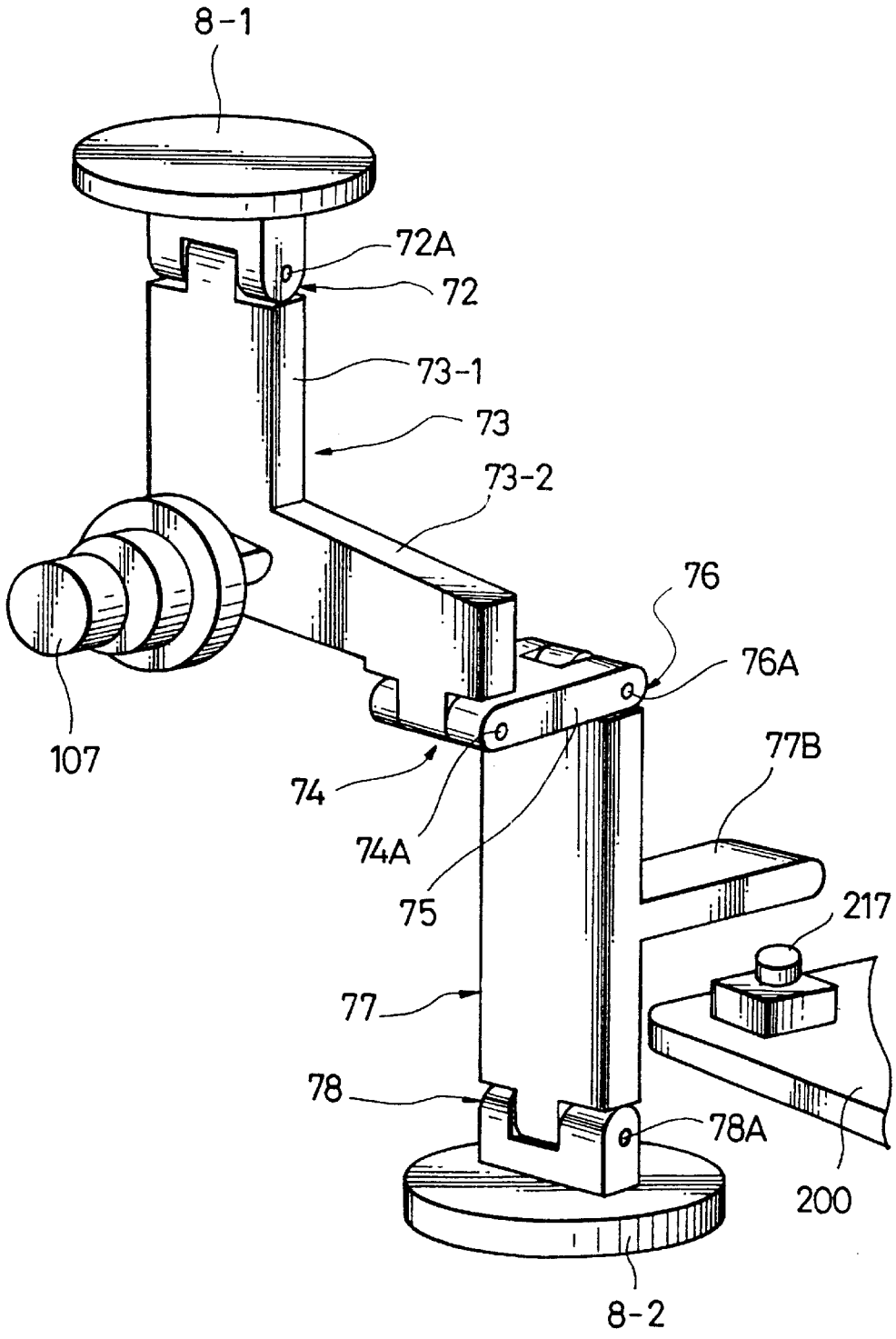
FIG. 16 is a perspective view showing part of the second example of the link equipment according to the present invention.
Figure 17:
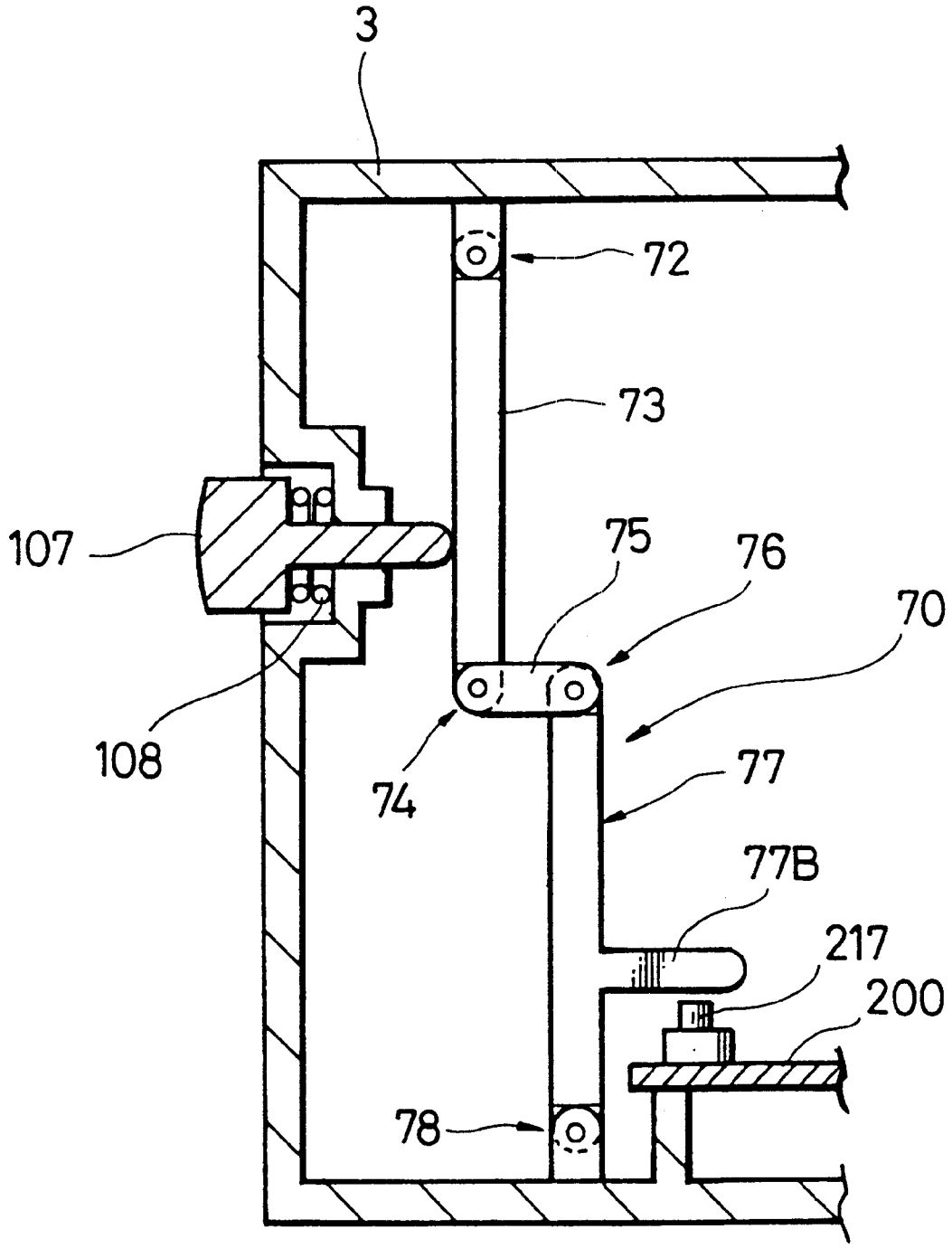
FIG. 17 is a cross-sectional view of the second example of FIG. 16.

Referring now to FIG. 16 and FIG. 17, the second example of the present invention will be described. In FIG. 12, only one link member 70 contained in the link mechanism of the present example is shown. This link member 70 has a first hinge 72, first lever member 73, second hinge 74, coupling member 75, third hinge 76, second lever member 77 of T-letter-form, and fourth hinge 78. Under the lower surface of the arm 77B of the second lever member 77, a switch 217 is mounted to the printed wiring circuit board 200.

Comparing the link member 70 according to the present example with the above-mentioned link members 10, 20, 30, 40, 50, 60 there are the differences in the structure of hinges and the construction of the lever member 73. The first through the fourth hinges 72, 74, 76, 78 of the present example are configured with hinges containing axles 72A, 74A, 76A, 78A as illustrated. The axles 72A, 78A of the first hinge 72 and the fourth hinge 78 may be mounted to frames 8-1, 8-2, but they may also be mounted directly to the cabinet 3. The use of hinge axles in place of thin-wall portions for hinges results in advantages of higher hinge rigidity. In particular, the rigidity against twisting of hinges increases.

The first lever member 73 may be formed in an L-letter form comprising the vertical portion 73-1 and the horizontal portion 73-2. On the outer surface, a suitable push-button 107 is mounted. In this example, a restoring force is applied to the push-button 107 by a spring 108 which is arranged in a recessed portion of the front surface of the cabinet 3.

The push-button 107 is mounted on the vertical portion 73-1 of the first lever member 73. Consequently, the line of force on the push-button deviates from the one on the switch 217. That is, the two force lines are not located on the same plane. By the force exerted on the push-button 107, the twisting force is exerted on the second lever member 77. However, since hinges are composed with hinge butts, sufficient rigidity is provided and even if a twisting force is exerted on the second lever member 77, the hinges will not be deformed. It is possible to vary the horizontal position of the push-button 107 by varying the length of the horizontal portion 73-2 of the first lever member 73.

Figure 18:
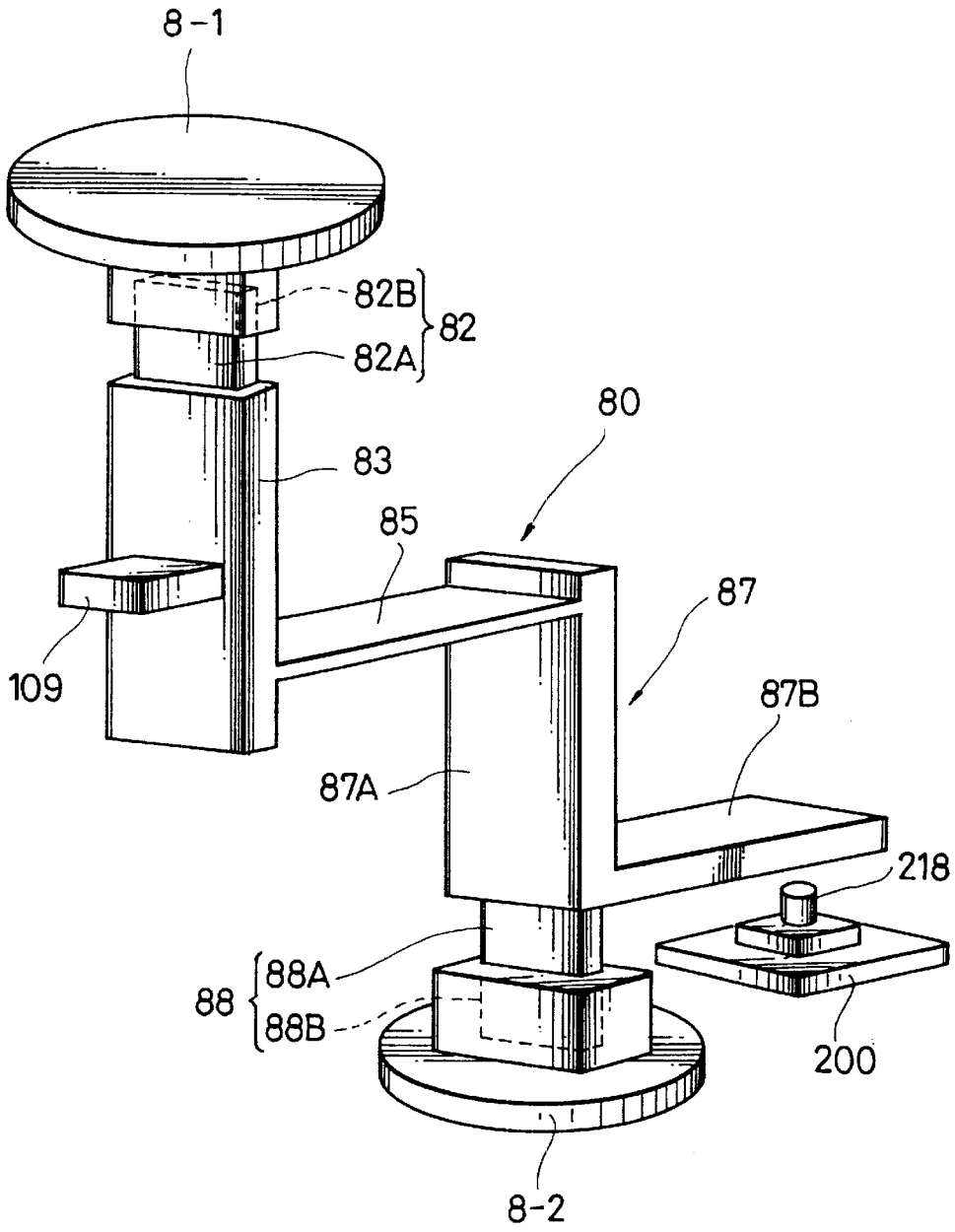
FIG. 18 is a perspective view showing part of the third example of the link equipment according to the present invention.
Figure 19:
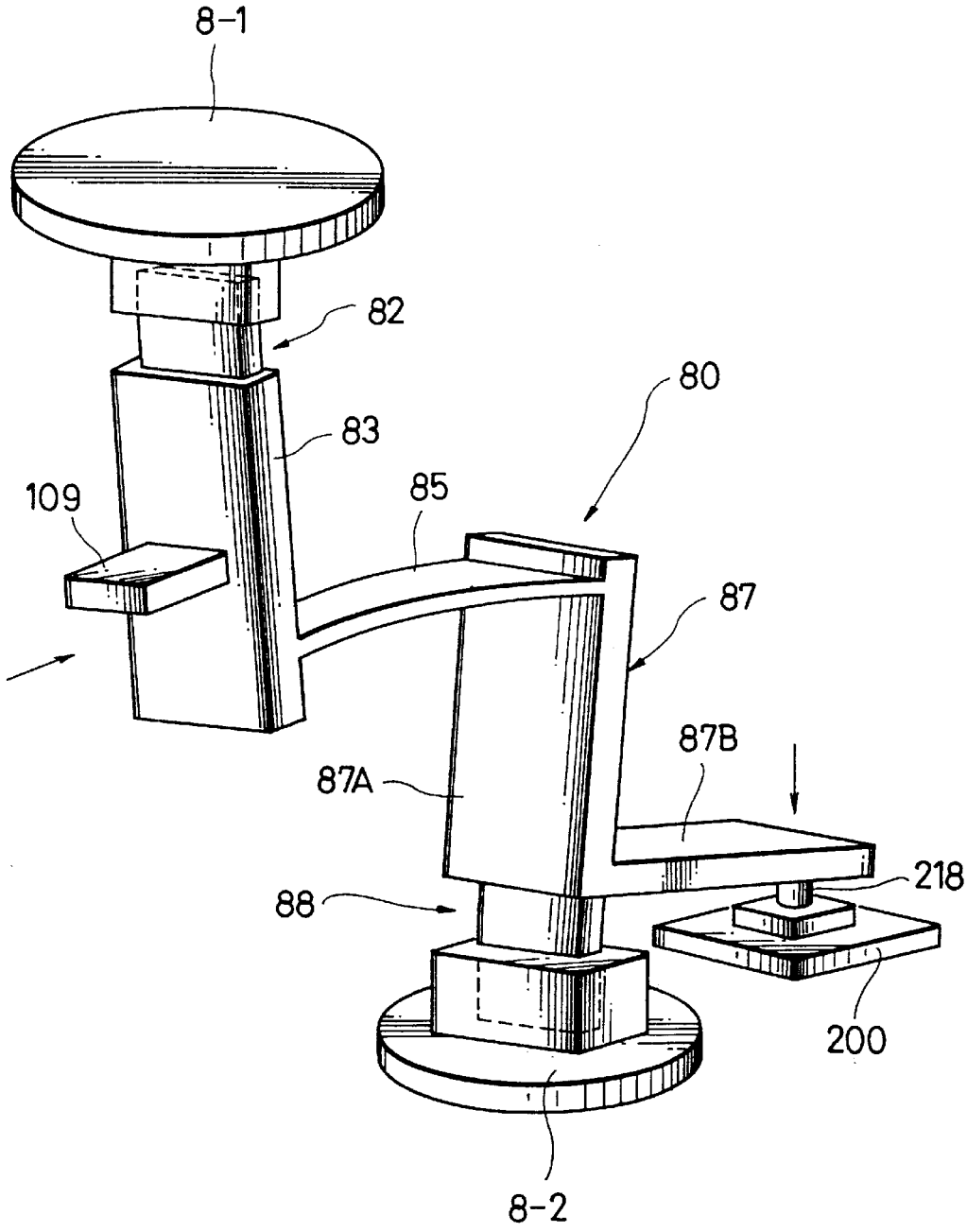
FIG. 19 is a perspective view showing part of the third example of FIG. 18 with the push-button pressed.
Figure 20A:
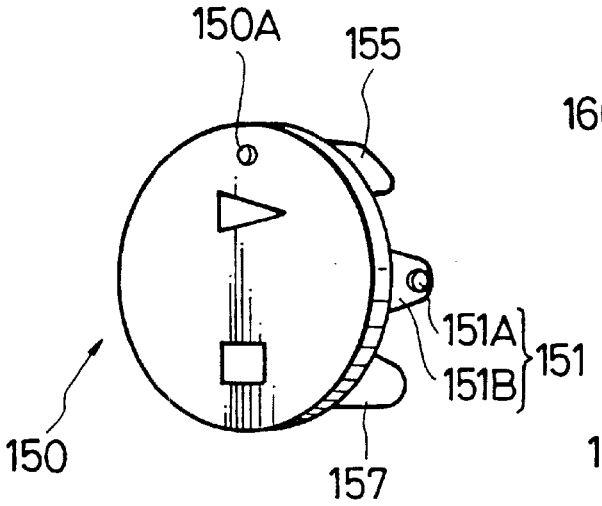
FIG. 20 is a drawing showing the construction of the button of the link equipment according to the present invention.
Figure 20C:
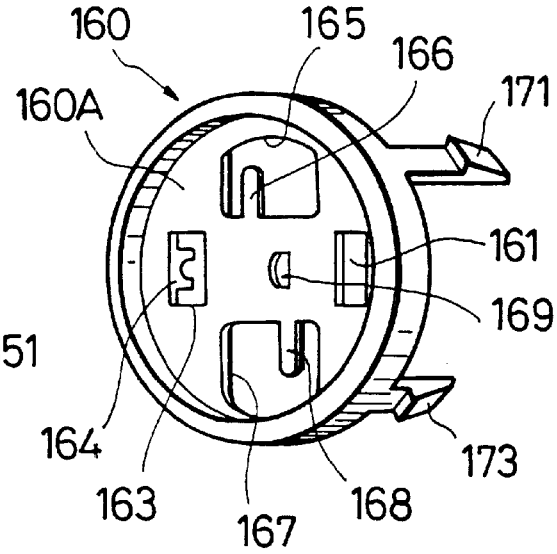
Figure 20B:
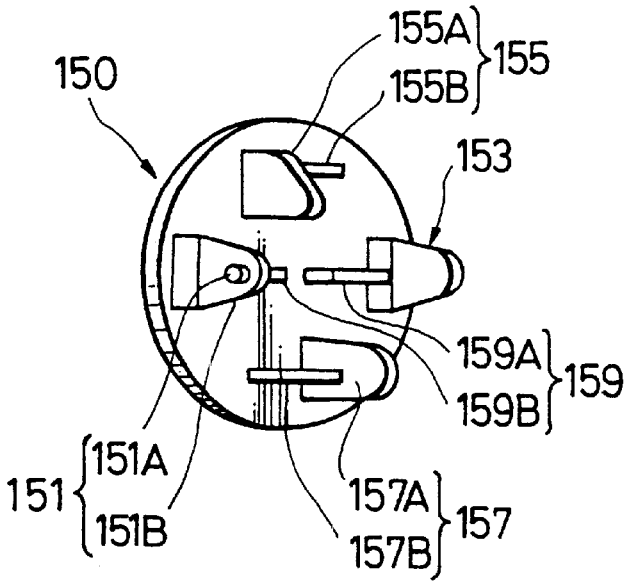
Figure 20D:
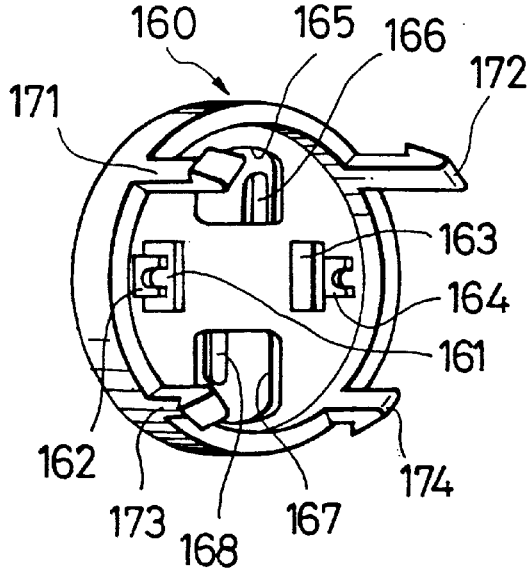

Referring now to FIG. 18 and FIG. 19, the third example of the present invention will be described. In FIG. 18 and FIG. 19, only one link member 80 containing the link mechanism of the present example will be shown. This link member 80 has the first hinges 82, first lever member 83, an elastic member 85, an L-letter-form second lever member 87, and the second hinges 88.

Comparing the link member 80 of the present example with the above-mentioned link members 10, 20, 30, 40, 50, 60 indicates there are differences in the construction of hinges 82, 88, and in that the elastic member 85 is used in place of the coupling member and the hinges on both sides thereof. The first and the second hinges 82, 88 of the present example comprise thin plate springs 82A, 88A and grooves 82B, 88B for holding the plate springs. The plate springs 82A, 88A of the first and the second hinges, first and second lever members 83, 87, and the elastic member 85 may be formed integral. The grooves 82B, 88B of the first and the second hinges 82, 88 may be provided in the frames 8-1, 8-2, or may be directly provided in the cabinet 3. By the way, in this drawing, the whole coupling member is made from the elastic member 85, but part of the coupling member, for example, the center portion only, may be formed with the elastic member.

As shown in FIG. 19, pressing the push-button 109 mounted on the first lever member 83 causes the first lever member 83 to pivotally move around the pivot axis passing through the first hinges 82, and the displacement is transmitted to the second lever member 87 via the elastic member 85. The second lever member 87 pivotally moves around the pivot axis passing through the second hinge 88, and the top end of the arm 87B moves downwards. By this, the switch 218 arranged under the bottom side of the top end of the arm 87B is actuated.

The first lever member 83 pivotally moves counterclockwise, while the second lever member 87 pivotally moves clockwise. Consequently, the motion locus of the lower end of the first lever member 83 does not coincide with the motion locus of the upper end of the second lever member 87. In the present example, deviation between the two motion loci is caused due to the first lever member 83 pivotally moving counterclockwise, while the second lever member 87 pivotally moves clockwise. Consequently, the motion locus of the lower end of the first lever member 83 does not coincide with the motion locus of the upper end of the second lever member 87. In the present example, deviation between the two motion loci is absorbed by the deformation of the elastic member 85.

In the second and the third examples shown in FIG. 12 through FIG. 19, the link members 70, 80 may be of those for operating the fast-feed/cue button 102 or rewind/review button 105, or may be of those for operating the recording button 101 or temporary stop button 106. Needless to say, they may be of those for operating the play/stop button 100.

Figure 21:
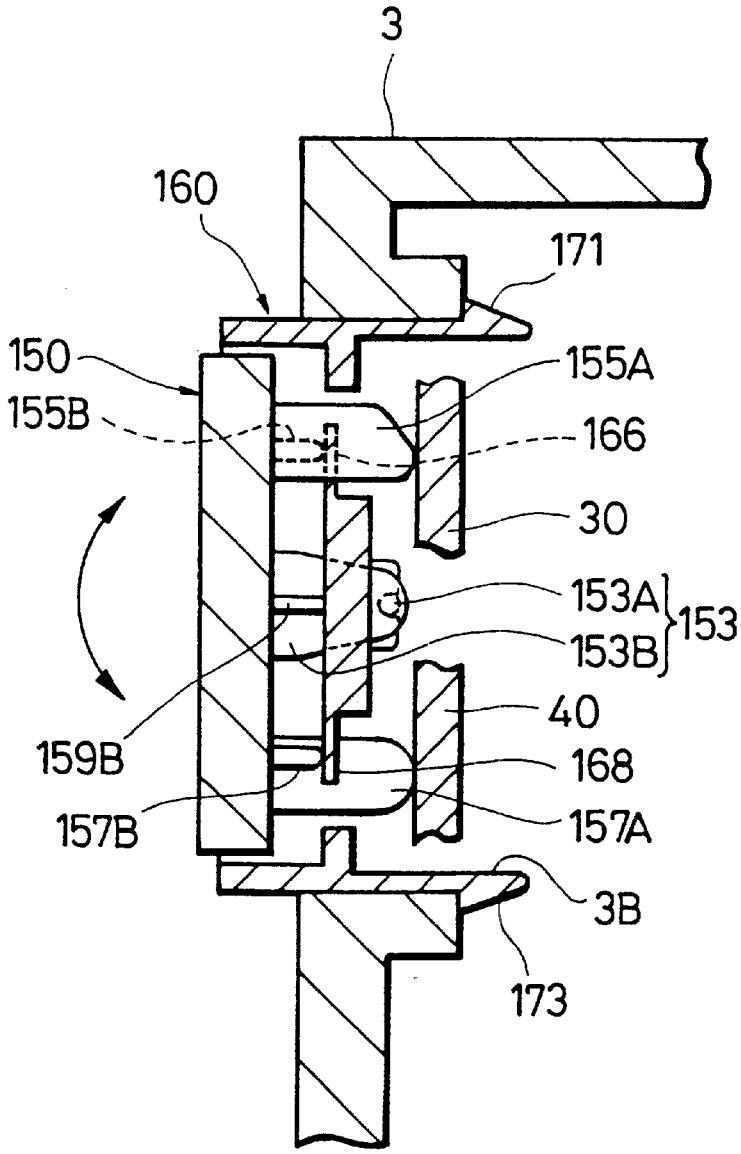
FIG. 21 is a cross-sectional view showing the construction of the button of FIG. 20.

Referring now to FIG. 20 and FIG. 21, the second example of the play/stop button 100 will be described. The play/stop button 100 of the present example has a nearly disk-form cover member 150 as shown in FIG. 20A and FIG. 20B and a frame member 160 as shown in FIG. 20C and FIG. 20D. On the surface of the cover member 150, a triangle meaning "play" is indicated on the upper side and a rectangle meaning "stop" is indicated on the lower side. In addition, above the triangle, a small protrusion 150A is provided so that the play/stop button 100 is able to be detected by touching. On the rear surface of the cover member 150, two pairs of protrusions arranged along the diameters crossing each other at right angle are formed.

The first pair of protrusions 151, 153 arranged along the horizontal diameter contain the pivot axles 151A, 153A and the support members 151B, 153B for supporting the pivot axles, respectively. The second pair of protrusions 155, 157 arranged along the vertical diameter contain the contact portions 155A, 157A and shoulder portions 155B, 157B on the side. On the rear surface of the cover member 150, the third pair of protrusions 159A, 159B are further provided along the horizontal diameter.

The frame member 160 has a recessed portion 160A for receiving the cover member 150, and on the bottom surface of the recessed portion, two pairs of openings 161, 163, 165, 167 corresponding to first and second pairs of protrusions 151, 153, 155, 157 of the cover member 150 are provided. On the edge of the first pair of openings 161, 163, bearing portions 162, 164 for receiving the pivot axles 151A, 153A are provided. To the second pair of openings 165, 167, spring members 166, 168 extending in the direction to cross the openings are mounted. The spring members 166, 168 may be formed integral with the frame member 160 as part of the thin-wall portion of the frame member 160 as illustrated.

On the bottom surface of the recessed portion 160A of the frame member 160, a protrusion 169 is further provided between the first pair of openings 161, 163. This protrusion is provided in correspondence with the third pair of protrusions 159A, 159B of the cover member for preventing the cover member 150 from being mounted in a wrong direction with respect to the frame member 160 in the assembly process.

Around the frame member 160, four claws 171, 172, 173, 174 are mounted, and to the top end of the claw, a protrusion is provided. These four claws are configured in such a manner as to be inserted into the corresponding opening portions of the cabinet. As illustrated, the upper two of the four claws are comparatively long, while the two on the lower side may be comparatively short. The cover member and the frame member may be formed integral, respectively, by molding.

The play/stop button 100 of the present example is assembled by inserting the cover member 150 into the recessed portion 160A of the frame member 160. The first and the second pairs of protrusions 151, 153, 155, 157 of the cover member 150 are inserted in the corresponding first and second pairs of openings 161, 163, 165, 167 of the frame member 160, respectively. The pivot axles 151A, 153A are engaged with corresponding bearing portions 162, 164 of the frame member 160, respectively. The shoulder portions 155B, 157B of the cover member 150 come in contact with spring members 166, 168 of the frame member 160.

The protrusion 169 of frame member 160 is disposed in between the third pair of protrusions 159A, 159B of the cover member 150. The protrusion 169 of the frame member 160 may function as a stopper for preventing relative displacement in the horizontal direction between the cover member 150 and the frame member 160. The third pair of protrusions 159A, 159B of the cover member 150 come in contact with the bottom surface of the recessed portion 160A of the frame member 160. The third pair of protrusions 159A, 159B of the cover member 150 function as a stopper for preventing the cover member 150 and the frame member 160 from coming closer to each other. The engagement of the pivot axles 151A, 153A with the bearing portions 162, 164 prevents the cover member 150 and the frame member 160 from moving in the direction of separating them from each other.

As shown in FIG. 21, the assembled play/stop button 100 of the present example is inserted in the opening 3B of the cabinet 3. As illustrated, the contact portions 155A, 157A of the second pair of protrusions 155, 157 of the cover member 150 come in contact with the third and the fourth link members 30, 40, respectively.

Pressing the triangle portion meaning "play" on the surface of the cover member 150 causes the cover member 150 to pivotally move clockwise around the pivot axles 151A, 153A, and the contact portion 155A and the shoulder portion 155B of the protrusion 155 above the second pair of protrusions of the cover member 150 move inwards. The movement of the contact portion 155A causes the third link member 30 to move. The movement of the shoulder portion 155B deforms the spring member 166, and the cover member 150 is subject to the restoring force, that is, counterclockwise pivotally moving force by the spring member 166.

Pressing the rectangle portion meaning "stop" on the surface of the cover member 150 causes the cover member 150 to pivotally move counterclockwise around the pivot axles 151A, 153A, causing the contact portion 157A and shoulder portion 157B of the protrusion 157 below the second pair of protrusions of the cover member 150 to move inwards. The movement of the contact portion 157A causes the fourth link member 40 to move. The movement of the shoulder portion 157B causes the spring member 168 to deform, and the cover member 150 is subject to the restoring force, that is, clockwise pivotally moving force by the spring member 168.

Although the embodiments of the present invention have been described in detail, it is easily understood by those skilled in the art that various changes and modifications may be made in the invention without departing from the spirit and scope thereof.

According to the present invention, it is possible to provide an electronic equipment in which the push-button position is comparatively easy to be freely chosen and the operability of the push-button device is satisfactory, as well as to provide a link equipment of such push-button device.

According to the present invention, it is possible to use a comparatively inexpensive flat-type switch without using a comparatively expensive longitudinal switch.

According to the present invention, since a construction in which the lever member is cantilevered by a hinge is not included, when the lever member is fabricated by molding, it is possible to avoid cases in which bends occur at the thin-wall portion of the hinges and defective products are generated.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A switch for electronic equipment comprising a lever mechanism with a protruding button to operate an electric switch mounted to a printed wiring circuit board for a main circuit of the electronic equipment by a linear force applied axially to said button, said lever mechanism comprising:

a first lever member disposed perpendicular to the axis of said button having an end thereof which is bendably connected to the electronic equipment via a first elastic portion and which is rotationally bent by the force applied to said button, a second lever member having an end thereof which is bendably connected to the electronic equipment via a second elastic portion and which protrudes in a direction perpendicular the axis of said button and which is equipped with an arm for operating said electric switch, and a coupling member for connecting said first lever member to said second lever member at ends thereof and rotating third and fourth elastic portions mounted to the ends of said coupling member to transmit a rotational displacement caused by the bend of said first lever member to said second lever member responsive to said linear force applied to said button.

2. The electronic equipment as claimed in claim 1, wherein said button is formed integral with said first elastic portion.

3. The electronic equipment as claimed in claim 1, wherein said first elastic portion is formed by providing a groove to said first lever member.

4. The electronic equipment as claimed in claim 1, wherein said second elastic portion is formed by providing a groove to said second lever member.

5. The electronic equipment as claimed in claim 1, wherein said lever mechanism has an integrally formed frame-form portion, said first and second elastic portions are linked to said frame-form portion equipped with a fitting portion for fixing to the electronic equipment, and said frame-form portion is fixed to the electronic equipment by said fitting portion.

6. The electronic equipment as claimed in claim 1, wherein a plurality of lever mechanisms are integrally formed in a frame-form.

7. A lever assembly for transmitting an axially directed linear force applied to a button mounted to an electronic equipment to an electric switch mounted on a specified location of the electronic equipment and a frame-form portion equipped with a fitting portion for fixing to the electronic equipment, and said lever assembly and said frame-form portion are formed from one member, said lever assembly comprising:

a first lever member disposed perpendicular to the axis of said button having an end thereof which is bendably connected to the electronic equipment via a first elastic portion and which is bent by said linear force applied by said button, a second lever member having an end thereof which is bendably connected to the direction electronic equipment via said second elastic portion and which protrudes in a direction perpendicular the axis of said button and is equipped with an arm for operating said electric switch, and a coupling member for linking said first and second lever members and rotating third and fourth elastic portions mounted to the ends of said coupling member to transmit a rotational displacement responsive to said linear force applied to said button.

* * * * *